United States Patent [19]

Strangio

[11] 4,022,097

[45] May 10, 1977

[54] COMPUTER-AIDED MUSICAL APPARATUS AND METHOD

[76] Inventor: Christopher E. Strangio, 43 Bailey Road, Watertown, Mass. 02172

[22] Filed: July 15, 1974

[21] Appl. No.: 488,821

[52] U.S. Cl. ..... 84/1.03; 84/337; 84/338; 84/462; 84/464; 84/DIG. 12; 84/DIG. 22

[51] Int. Cl.[2] ..... G10B 3/10; G10H 5/02

[58] Field of Search ..... 84/1.01, 1.03, 1.28, 84/12, 18, 25, 115, 337–339, 461, 462, 464, DIG. 29, DIG. 12, DIG. 22

[56] References Cited

UNITED STATES PATENTS

| | | | |
|---|---|---|---|
| 3,160,051 | 12/1964 | Guenther | 84/337 |
| 3,277,245 | 10/1966 | Sponga | 84/462 X |
| 3,604,299 | 9/1971 | Englund | 84/1.03 |
| 3,647,929 | 3/1972 | Milde, Jr. | 84/1.01 |
| 3,683,096 | 8/1972 | Peterson et al. | 84/115 |
| 3,771,406 | 11/1973 | Wheelwright | 84/464 |
| 3,781,452 | 12/1973 | Vauclain | 84/1.28 |
| 3,789,719 | 2/1974 | Maillet | 84/115 |
| 3,829,597 | 8/1974 | Peterson et al. | 84/1.03 |
| 3,882,751 | 5/1975 | Tomisawa et al. | 84/1.01 |
| 3,889,568 | 6/1975 | Amaya | 84/1.01 |
| 3,890,871 | 6/1975 | Oberheim | 84/1.01 |
| 3,915,047 | 10/1975 | Davis et al. | 84/1.03 |
| 3,926,088 | 12/1975 | Davis et al. | 84/462 |
| 3,958,483 | 5/1976 | Borrevik et al. | 84/1.03 |

*Primary Examiner*—Stanley J. Witkowski
*Attorney, Agent, or Firm*—Rines and Rines

[57] ABSTRACT

This disclosure is concerned with simplifying the performance of musical compositions and the like by triggering the release of successive electronically stored coded data corresponding to the successive notes of the musical composition and in accordance with the rhythm thereof, and, upon such release, decoding the successive data to generate electrical oscillations which are then converted into corresponding audible tones of the notes of the composition.

20 Claims, 38 Drawing Figures

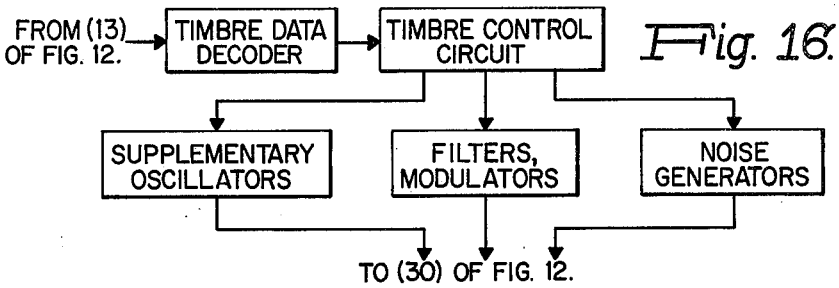
Fig. 16.
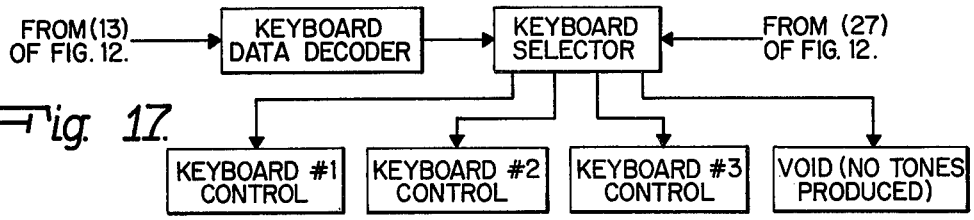
Fig. 17.
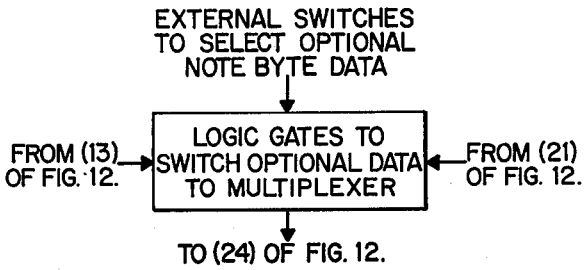
Fig. 18.
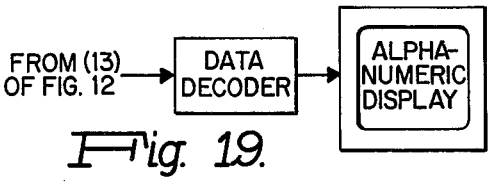
Fig. 19.
Fig. 20.
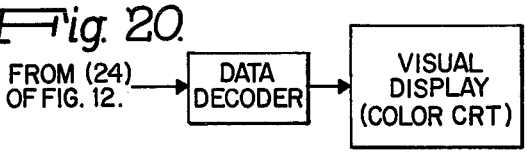
Fig. 21.
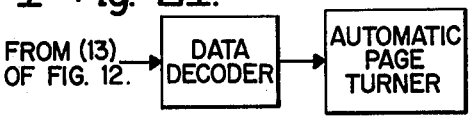
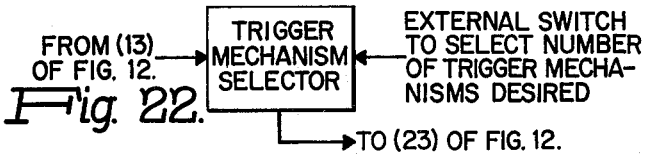
Fig. 22.
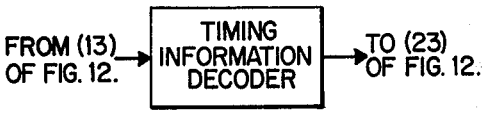
Fig. 23.
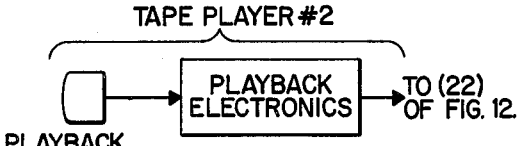
Fig. 24.
Fig. 25.
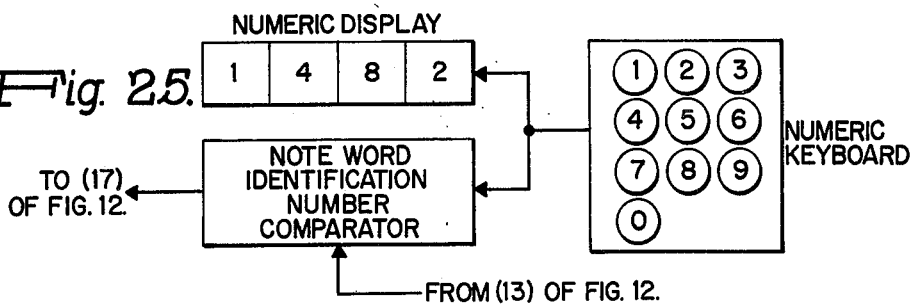

COMPUTER-AIDED MUSICAL APPARATUS AND METHOD

The present invention relates to electronic musical instruments and techniques, being more particularly directed to computer-aided musical apparatus and methods.

From the early days of commercial musical instruments, apparatus has been evolved for simplifying and even automating the human operation of the instruments; such apparatus varying from keyed mechanisms for generating the tone sounds, to player pianos and chord organs and the like. The advent of the electronic organ and similar instruments has also been accompanied by operating mechanisms designed to enable even the relatively unskilled performer to play compositions with substantial precision. In U.S. Pat. No. 3,015,979 (and patents cited therein), for example, pre-programming of the selection of fundamental frequencies of vibration is effected by a punched paper tape incrementally advancing over a set of sensing brushes when the downward motion of a key or mechanically linked pushbutton is imparted, to operate electronic tone-producing circuits.

While such prior art systems do facilitate the performer in the operation of the instrument, they are inherently limited by the nature of the paper-tape or similar programming and brush switching mechanisms, and thus are limited in flexibility and application, being particularly not suited for difficult and complex musical compositions.

An object of the present invention, accordingly, is to provide a new and improved electronic musical apparatus and method, unrestricted in the above limitations and others, and that significantly expands the flexibility and sophistication of programmed control of the instruments.

A further object is to provide a novel electronic computer-aided and programmed musical apparatus and method.

Still an additional object is to provide, more generally, an improved computer-controlled electronic signal generating apparatus and method that is adapted similarly to facilitate simplified operation through such computer aiding.

Other and further objects will be explained hereinafter and are more particularly delineated in the appended claims, it being understood, as immediately above indicated, that while the invention is particularly directed to the operation of musical tone generation, it may obviously analagously be applied to other electronic signal apparatus wherein similar-purpose simplification and flexibility are desired.

In summary, from its important application in the illustrative and preferred embodiment of musical instruments of the piano or organ type and the like, the invention, from one of its broader objects, contemplates a method of electronically aided musical performance that comprises electronically storing coded data corresponding to successive musical notes in a musical composition; successively triggering the controlled release of successive coded data from said storing in accordance with the rhythm of such composition; upon said release, decoding the successive data to generate electrical oscillations corresponding in frequency to the corresponding musical notes; and converting said oscillations into the corresponding audible tones of the notes of the composition.

Preferred details and apparatus are hereinafter described.

The invention will now be described with reference to the illustrative musical instrument application and in connection with the accompanying drawings, FIG. 1 of which is an elementary and simplified block diagram illustrating some of the basic principles of the method and apparatus of the invention;

Figure 26:
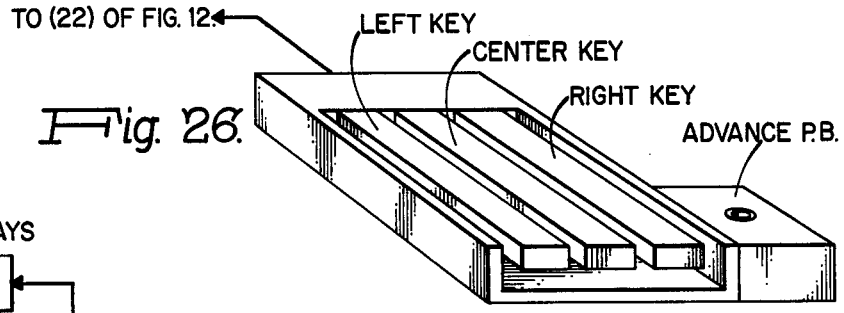
Figure 27:
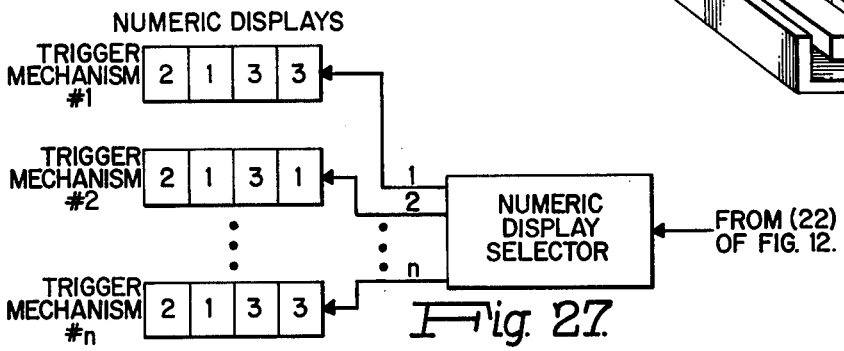
Figure 29:
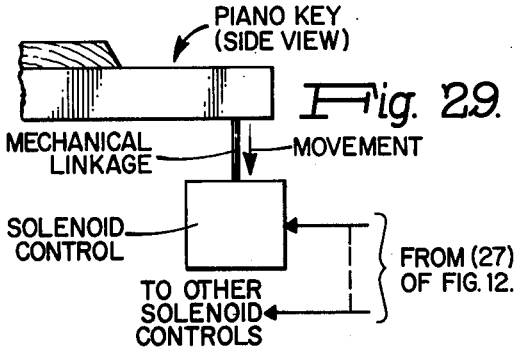
Figure 28:
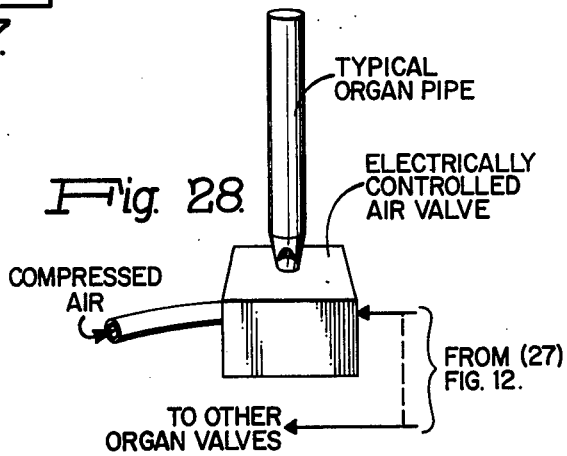
Figure 30:
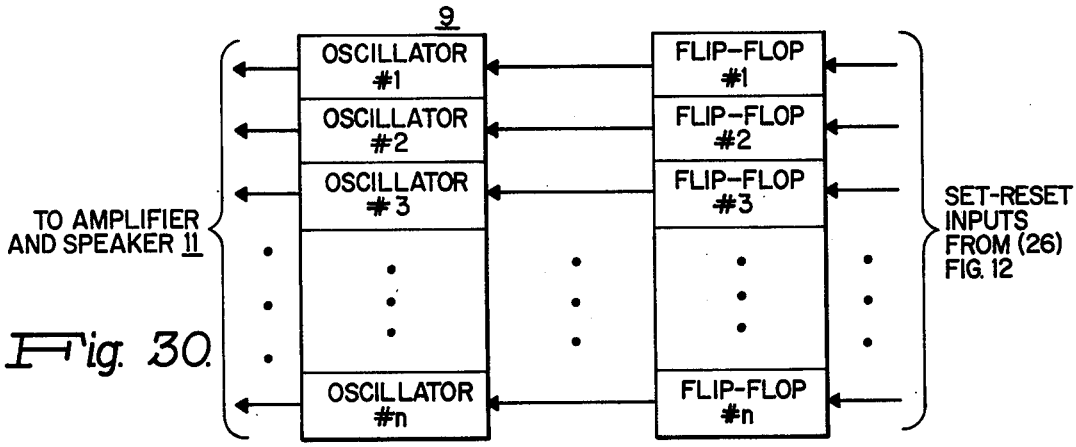
Figure 31:
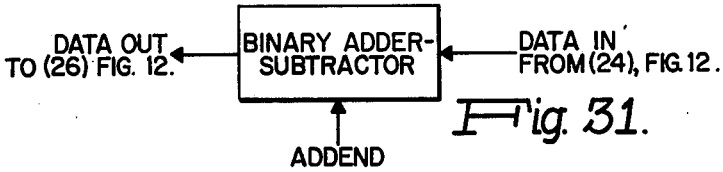
Figure 32:
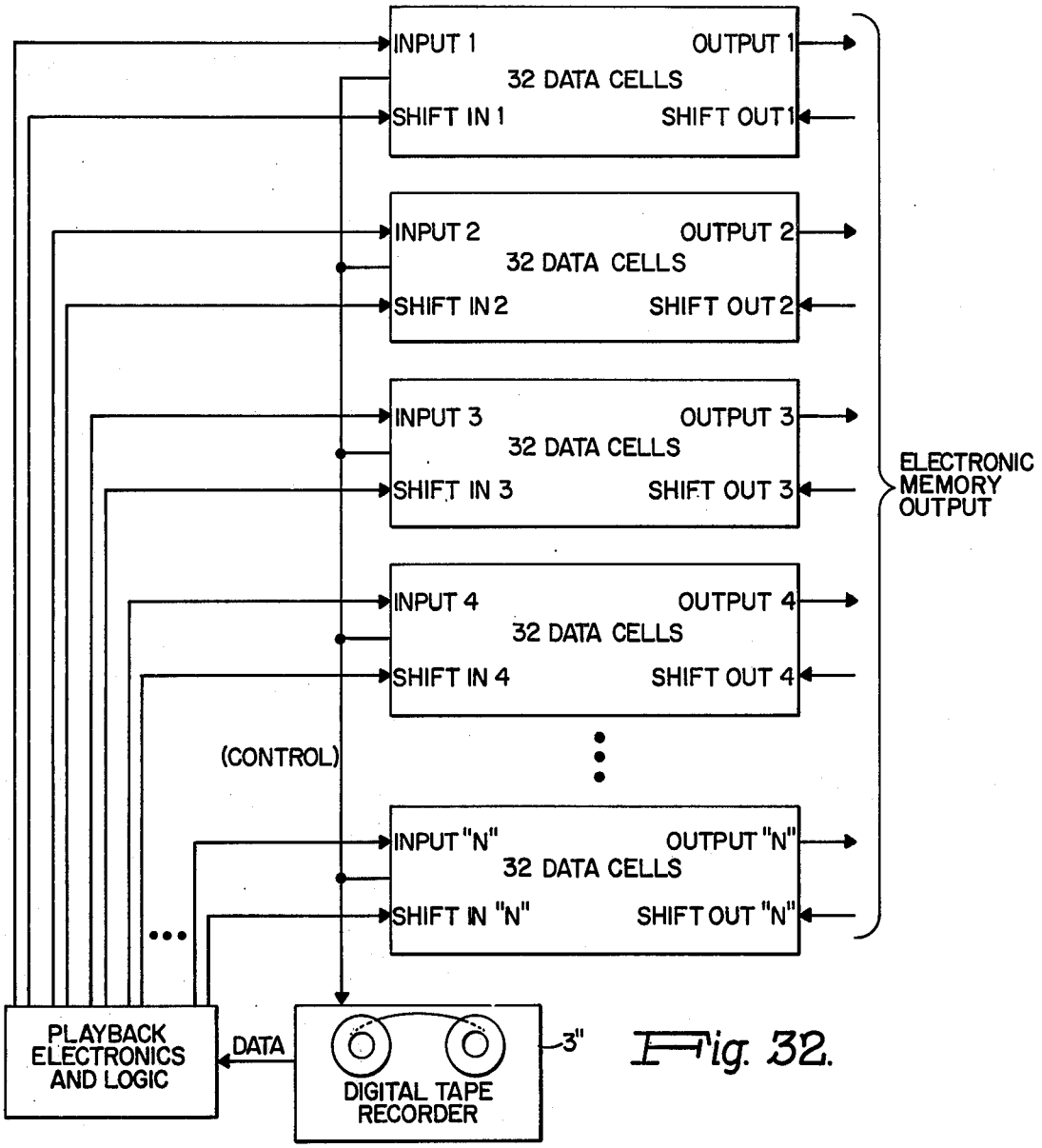
Figure 33:
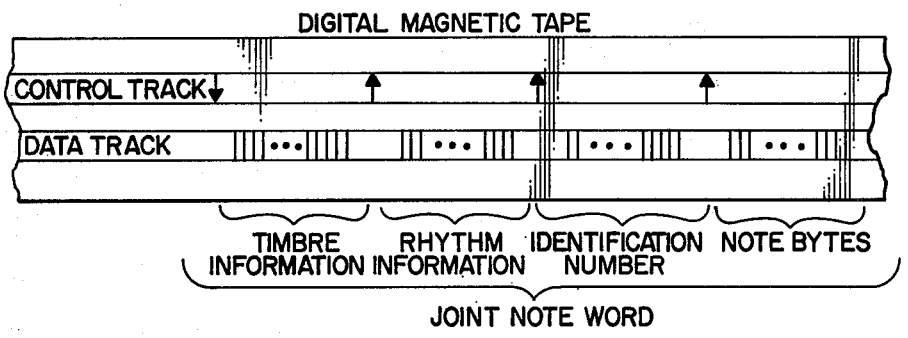

FIGS. 16 thru 19 are fragmentary block diagrams of suitable circuit modifications for respectively providing timbre control, keyboard selection control, multiplex operation and alpha-numeric display of the decoded data;

FIGS. 20 thru 24 are similar diagrams of modifications suitable for providing, respectively, visual data display, automatic page turning, trigger mechanism selection, timing information de-coding, and supplemental tape player mechanisms;

FIGS. 25 and 27 are similar diagrams illustrating suitable circuits and mechanisms for enabling numeric display;

FIGS. 26, 28 and 29 are fragmentary views of keying structures, organ pipe controls that may be effected in accordance with the invention, and piano or similar keyboard linkages, respectively;

FIG. 30 is a more detailed block diagram of flip-flop-oscillator controls useful with the modification of the invention;

FIG. 31 is a block diagram of an adder-subtractor circuit suitable for use with the invention;

FIG. 32 is a block diagram of multiple data cell operation in the electronic memory of the invention; and FIG. 33 is a schematic diagram of data digitally recorded on tape in accordance with the invention.

Prior to describing a preferred embodiment, in order more fully to enable an understanding of the same, it is in order to review the motivation and philosophy behind the invention and briefly to contrast the same with prior art of the above-mentioned and other types.

One of the most common musical instruments in the modern home is the piano, followed closely by the electronic organ. Understandably, this is a reflection of the fact that a great many people have at last rudimentary keyboard skill. This skill would include the ability to translate printed musical notation into note locations and durations on the keyboard, and to operate the digitals of the keyboard with some efficiency. Except for the simplest musical compositions, a degree of practice is necessary before the performer can accurately play a piece of music at the proper rate.

The technique of reading music calls for the performer to focus his or her eyes on the printed music while blindly choosing the appropriate digitals beneath the fingers. The average hand can reach an interval of about eight inches; yet the music being read by the performer may command the choice of digitals distributed over a span of 4 feet. The arm movement necessitated by this physical limitation makes maintenance of a fixed reference point very difficult. The performer may sometimes find it necessary to take his or her eyes off of the musical notation to look down at the keyboard and locate a particular note. When the note is found, the performer must return the eyes to the notation, find the place, and continue. This type of procedure leaves the performer highly susceptible to errors and fatigue. Additionally, the mental processing required in the translation of printed symbols to note locations is usually non-trivial, particularly when one considers key signatures, accidentals, and the ambiguity of different stalves.

To overcome these difficulties and the before-mentioned limitations of prior art proposals, the present invention embodies a novel computer machine-assisted technique of performing musical compositions on keyboard instruments that, though simplifying, does not oversimplify the process of performing music on keyboard instruments. It does so by first eliminating the physical constraint of hand size and mobility, and then by vastly simplifying the process of translating printed musical notation into movements enacted on a keyboard. The machine and the technique may thus collectively be referred to as "Computer-Aided Musical Interpretation."

Among the advantages offered by such computer-aided music interpretation are the following:

1. Complex keyboard compositions can be performed very competently with a minimal amount of practice. While a performer is capable of making errors with the invention, as later explained, because the mental and physical skills required are less stringent, the likelihood of error is reduced considerably.
2. Many difficulties encountered in the normal sight reading of music are eliminated. For example:
   a. It becomes no more difficult to play a piece in G# minor than one in A minor; accidentals become irrelevent to performance skills.
   b. Quite frequently, normal sight reading calls for non-trivial finger movements in order to strike the appropriate keyboard digitals. With the invention, sophisticated fingering is eliminated.
   c. The physical limitations of hand size and number of fingers become non-existent. Thus, people with small hands are no longer confined to unambitious musical compositions, and people in general will be able to play keyboard music that ordinarily would be impossible to play with only two hands.
3. Complex musical compositions normally requiring two or more instruments may be performed by a single individual on the keyboard. Indeed, with a large enough system, a single individual could play all the notes of a symphony orchestra performance.
4. Blind people may easily learn to play music with the aid of the invention. The required rhythm for a musical composition could be recorded in braille from which a blind person may learn. Having learned the rhythm, such a blind person could sit before two trigger mechanisms, hereinafter described, and realize the music without any actions requiring vision.

It is next in order to delineate the basic elements underlying the physical realization and operation of the invention.

BASIC OPERATION

A musical composition can be broken down into essentially two basic components: (a) a collection of audible tones, and (b) a time distribution for the collection of tones. A collection of tones alone could be mothing more than noise; while a time distribution alone could be nothing more than rhythm. Yet a collection of tones taken together with a time distribution is a basis for music. The task of the musical performer is to assemble the collection of tones that represent a musical composition with the proper time distribution. While performances very from one time to another, and from performer to performer, if the performance is accurate, it will always include the same collection of tones. Variance between performances, then, results not from differences in the collection of tones that represent a musical composition, but rather from differences in their time distribution. Accordingly, an important feature of the invention in this application, is to mechanize the selection of tones in a musical performance without affecting the performer's ability to bring forth the tones in the proper time distribution.

To illustrate the central idea behind the invention, consider the C major scale. Ordinarily, the performer must decide which symbol corresponds to which digital on the keyboard, and thence place the appropriate finger on the appropriate digital at the appropriate time. With the invention, however, the specific notes which compose the C major scale will be numerically encoded and recorded in an electronic memory in the proper sequence. The performer then need only call the notes from the electronic memory when the performer's judgement so commands. The process of calling the notes from the electronic memory is the only action that need be taken by the performer, since the actual choice of notes has been prerecorded in the electronic memory.

Calling notes from the electronic memory is accomplished by the use of a trigger pushbutton. When it is desired to elicit a note from memory and cause it to sound, the pushbutton will be depressed and held for the length of time the note is to sound. Upon release of the pushbutton, the note will cease to sound and the electronic memory will automatically advance to the next note in the sequence. No further sounds will be produced until the trigger pushbutton is again depressed. This procedure is illustrated in a very simplified verion in FIG. 1, wherein the trigger pushbutton 1, when depressed, will, for example, cause the prerecorded numerically embodied signal corresponding to the first note C of the scale, in the above example, to be applied from the memory 3 via a control circuit 5 to a decoder 7 which will then cause the appropriate electronic tone generator, from oscillator bank 9, to produce the vibration of C-frequency in the loudspeaker 11, which then converts or transduces the same into corresponding audible tone. Following release of the trigger pushbutton 1, the C tone will cease. Upon a future depression of the trigger pushbutton, the next encoded signal prerecorded in the memory 3, corresponding to the next scale note D in this illustration, will similarly be fed out for decoding and generating an oscillation of D-tone freqency; and so on for additional notes. Through the use of a plurality of such systems as in FIG. 1, the invention would also enable a single depression of the trigger pushbutton to sound several musical tones simultaneously, thus allowing for the production of chords.

Figure 1:
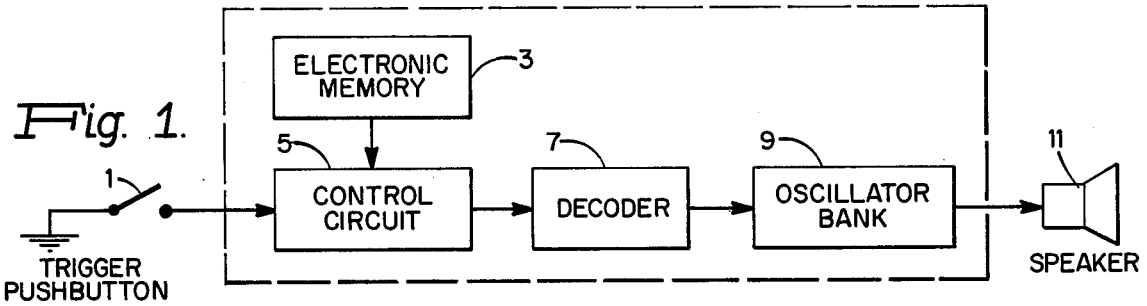

Two or more trigger pushbuttons, moreover, could be available to be operated with both hands by the performer. The trigger pushbutton, furthermore, would not be simply a single button or switch, as schematically shown in FIG. 1, but rather a configuration of several pushbutton type switches physically made to resemble keys of a piano or organ keyboard. The depression of any one key would cause generation of a trigger signal to elicit and sound a note from the electronic memory. In this way, the electrical function would be satisfied while at the same time simulating the actual striking of a note at an authentic keyboard instrument. The assemblage of pushbuttons in the form of piano type keys, along with associated circuitry, may hereafter, indeed, be referred to as the "trigger mechanism".

Consider an electronic organ with a 60-note keyboard. Ordinarily, each key of the keyboard will correspond to one fundamental frequency of vibration on the musical scale. (Of course, modern electronic organs offer great flexibility in that any one key may be made to elicit a multitude of different tones and timbres. That quality is not, however, relevant in a discussion of the present invention, and only the general case of one tone per key is important.) Assume that a single electronic oscillator is provided for each note on the keyboard, and that when a key on the keyboard is depressed, the oscillator corresponding to that key will produce the appropriate tone of the musical scale. An electronic organ of this type equipped with the present invention would, in addition, contain a bank of 60 flip-flops, adapted, in one version, to be connected with one flip-flop internally connected to each oscillator, as shown in FIG. 30. When a flip-flop is "set," the oscillator connected to that flip-flop will produce its tone. When a flip-flop is "reset," as more particularly provided for in the hereinafter described embodiment of FIG. 12, the oscillator connected to that flip-flop will remain silent. The bank of 60 flip-flops will be operated by the control circuit 5 which is capable of selecting one flip-flop and causing it either to set or reset. Thus, the control circuit will simply be turning appropriately selected notes on or off. Determination of which notes are to be turned on or off is based on the data stored in the electronic memory 3, and occurs in time on the command of one or more keys of trigger mechanisms 1, as operated by the performer. Before the synergistic effect of these components can be fully realized, a closer look at the electronic memory, the trigger mechanisms, and their interconnection is necessary.

MEMORY FUNCTIONS

Figure 2:
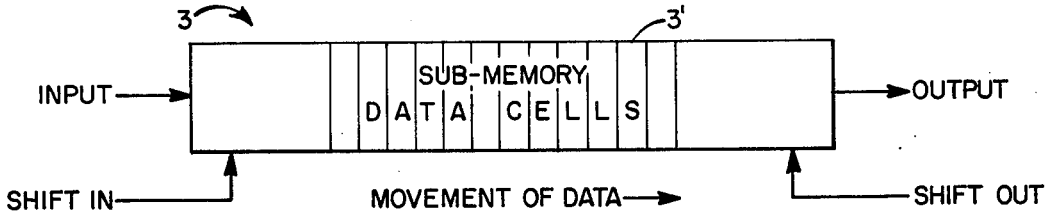
FIGS. 2, 3 and 4A are more detailed block diagrams of the sub-memory construction and operation within the memory system of FIG. 1.

The electronic memory 3 can be separated into an integral number of identical sub-memories 3'. The sub-memories act as buffers between a mass storage medium, such as digital magnetic tape, and the electronic control circuitry. Each sub-memory is responsible for storing a sequence of binary numbers which, when properly decoded, represent unique notes of the musical scale. A sub-memory will always be required to store a sequence of numbers in the exact order in which they were loaded and will never be requested to bring to its output terminals one of the numbers out of order. Thus, the sub-memories can be of the "First-in First-out" type as illustrated in FIG. 2. In this type of memory device, data entered at the input terminal propagates toward the output, filling the vacant cell closest to the output. In this manner, all valid data is consolidated at the output, while vacancies are compressed towards the input. Shift-in pulses and shift-out pulses may occur independently and asynchronously. Thus, musical data may be shifted out if the sub-memory is filled partially but not completely.

A sequence of numbers provided by a mass medium such as a digital magnetic tape, is loaded into the sub-memory 3'of FIG. 2 by the successive application of "shift-in" pulses. For each shift-in pulse, the binary number present at the input terminal is loaded into the first cell of the bank of cells labeled "Data Cells," and then propagates toward the output, filling the vacancy closest to the output. This process continues until the sub-memory 3' is loaded to capacity at which time the mass medium supplying the data is signaled to halt. The output will initially present the first number that was loaded into the sub-memory, and will advance from number to number upon receipt of "shift-out" pulses. Since shift-in pulses and shift-out pulses are independent, they may occur simultaneously. If the average rate of shift-in pulses is the same as the average rate of shift-out pulses, data is being removed from the sub-memories at the same rate it is being entered, and hence the sub-memories will never become filled to capacity or emptied to depletion. The output sequence will be exactly the same as the input sequence. Since the binary numbers presented by the output represent unique notes of the musical scale, the sub-memory 3' is thus, in essence, storing a sequence of individual musical notes.

Figure 3:
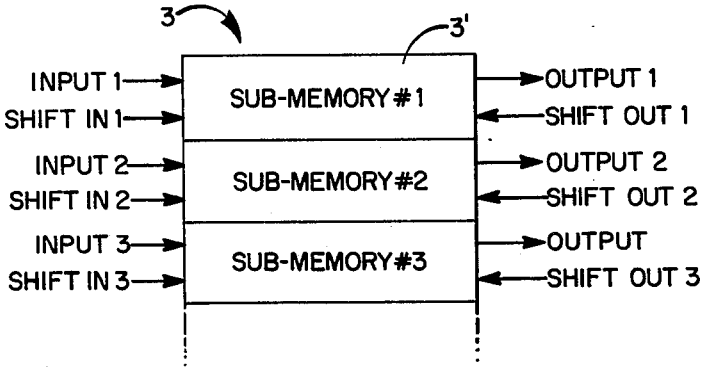

The full electronic memory 3 is made up of a multitude of such sub-memories 3' arranged in parallel as shown in FIG. 3. The total number of sub-memories 3' required is determined by the maximum number of musical tones that are to sound simultaneously when performing a musical composition. A composition which includes, for example, an eight-note chord, will require an electronic memory with at least eight sub-memories, though well-known multiplexing schemes may, if desired, be employed to reduce this number. There may, however, be times prior to, and subsequent to, the eight-note chord when perhaps only two or three notes are to sound simultaneously. When this is the case, the outputs of the unused sub-memories 3' will present binary numbers which represent silence and, when decoded at 7, correspond to no note of the musical scale.

The depth of each sub-memory (and hence the memory as a whole) is chosen by the skilled designer to be adequate to buffer the connection between the mass storage medium and the electronic control circuitry. This choice is based upon the maximum expected rate at which note data will be shifted out by triggering, the rate at which data is supplied by the mass medium, and the ease with which the mass medium may be started and stopped.

THE TRIGGER MECHANISMS 1 AND THEIR INTERCONNECTION WITH THE ELECTRONIC MEMORY 3

The electronic machine and the human performer are coupled by trigger mechanisms. A trigger mechanism 1, as before explained, is simply a device whereby depression of one of several keys at the input produces a change of electrical potential or level at the output; the relationship of high and low output potential with depressed and released portions of the key being shown in FIG. 4B. The change of potential will persist so long as the key initially depressed is maintained in the depressed state. When the key is released, the output potential will return to the value held prior to the depression of the key. All keys of the trigger mechanism 1 are identical and cause the same change in potential at the output when depressed. The performer will ordinarily operate the trigger mechanism with fingers of the hand, and will usually use more than one finger. In any case, only one key is to be depressed at any one time.

Figure 4A:
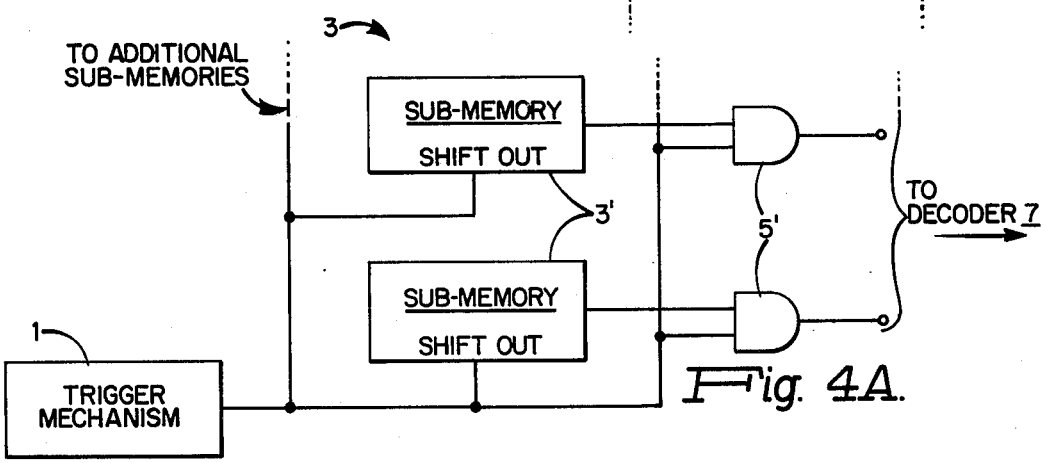
Figure 4B:
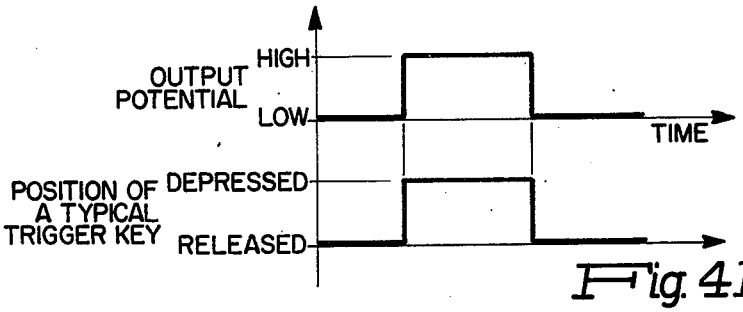
FIG. 4B is a waveform diagram illustrating the operation of the system of FIG. 4A.

The object of a trigger mechanism is twofold. First, it is to provide shift-out pulses for one or more sub-memories 3'; and second, the time duration of the output signal is to determine the time that one or more musical notes are to sound. With a trigger mechanism 1 connected to one or more sub-memories as shown in FIG. 4A, a performer can turn on one or more musical notes by depressing any one of the keys of the trigger mechanism. The note or notes will continue to sound so long as the key is held depressed, and will ordinarily cease to sound when the key is released. Sometimes it is desirable to have a note continue to sound after the trigger key is released. Determination of whether or not a note is to be sustained is made, as later shown, by sensing a particular bit position of the numerical code representing the note. Upon release of the key, the output of the trigger mechanism will change from its depressed potential to its released potential, and this trailing edge will serve to create a shift-out pulse for one or more sub-memories. The shift-out pulse advances each sub-memory connected to the trigger mechanism to the next note in the sequence. The sub-memory outputs are connected, as shown in FIG. 4A, through AND gates 5' to the decoder 7, thence to control the tone oscillators 9. By depressing the trigger keys with the proper rhythm, the performer will thus recreate the musical composition whose notes are encoded and stored in the sub-memories.

When operating a trigger mechanism with more than one finger, it is possible that the release of a key with one finger will overlap with the depression of a second key with another finger. It is this eventuality that makes ineffective the motion of parallel-connected electrical pushbuttons to implement the trigger mechanism. If a simple parallel connection of pushbuttons were used, then when overlap occurs, the output would be maintained at its depressed potential even though a transition from one trigger key to another has been made. The absence of a trailing edge at the output will prevent advancement of the sub-memories and a beat of the rhythm will have been missed. A viable implementation is one where a trailing edge is generated regardless of the degree of overlap; and a preferred electronic circuit that will achieve this is hereafter presented in detail.

In general, more than one trigger mechanism will be used in a musical performance. When multiple trigger mechanisms are used, each one will be assigned uniquely to control certain sub-memories of the electronic memory, as in FIG. 5. When all trigger mechanisms are collectively operated by the performer with the proper rhythm, the musical composition will be reproduced. The degree of skill required of the performer increases rapidly as the number of trigger mechanisms increases. The overall skill, though, even with two or three trigger mechanisms, is well below that required to play the same composition manually without the help of the invention.

Figure 5:
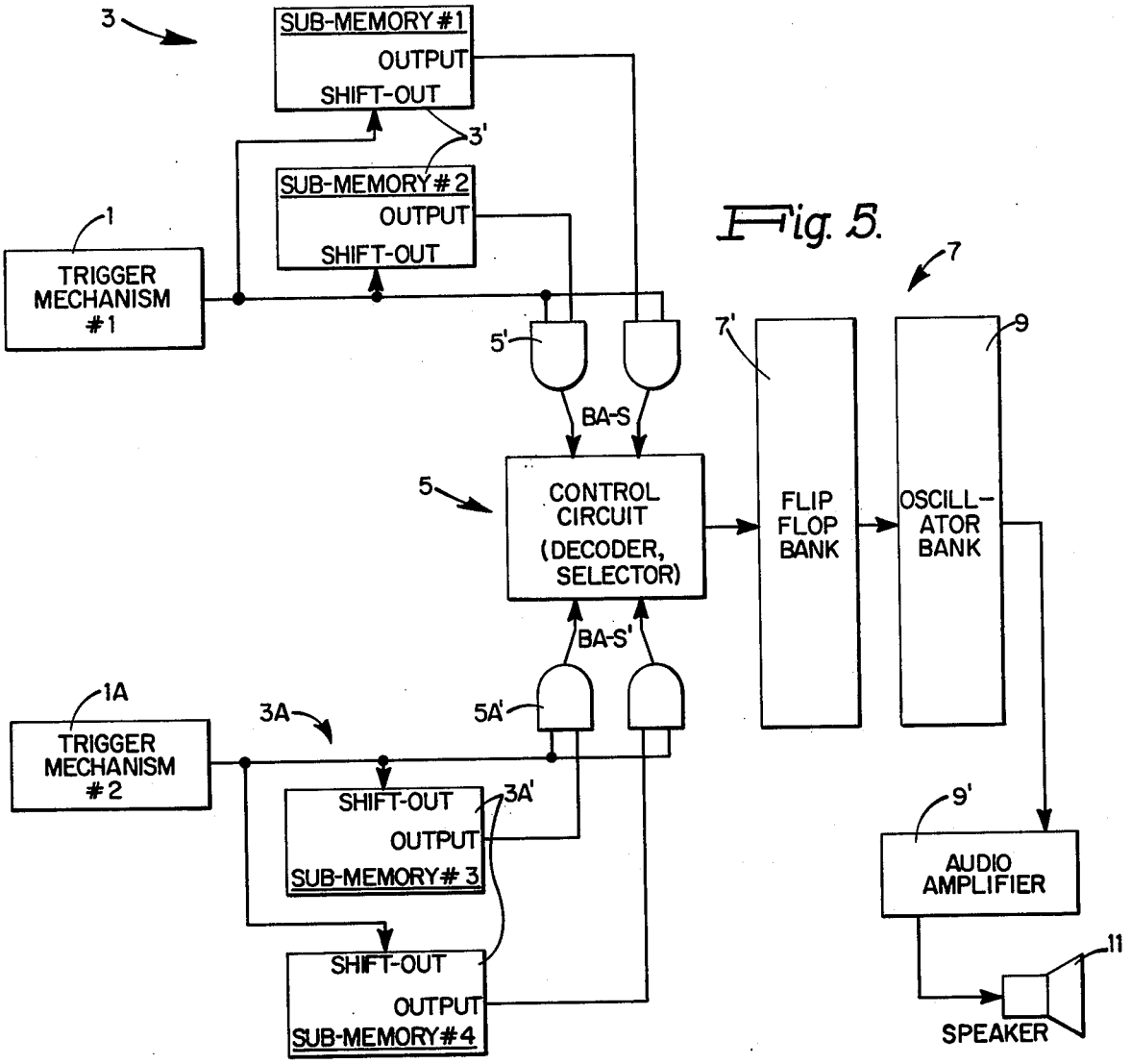
FIG. 5 is a more detailed block and partial schematic diagram of the system of FIG. 1.
Figure 10:
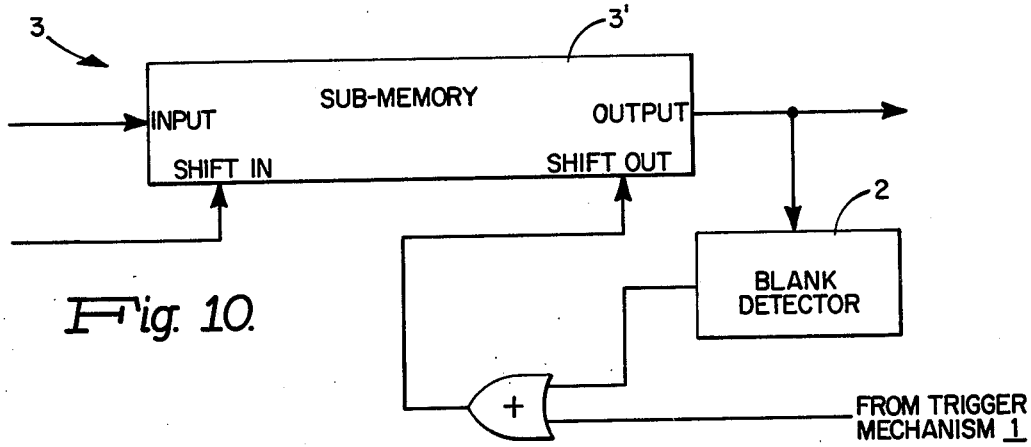
FIG. 10 is a combined block and partial schematic diagram of suitable hardware for automatically shifting out dummy note words.

A more detailed configuration of trigger mechanisms and sub-memories is shown in FIG. 5 along with the control circuit 5 and its AND inputs 5' and 5A', flip-flop bank 7' of decoder 7, oscillators 9, audio amplifier 9', and speaker 11, thus to comprise an entire system. In this system, two trigger mechanisms 1 and 1A are present, each controlling a pair of sub-memories 3' and 3A'. In the general case, the number of trigger mechanisms, the number of sub-memories, and the assignment of trigger mecanisms to sub-memories may, of course, be different. The configuration of FIG. 5 was chosen as an example because it is simple enough to make the operational concept clear, yet sophisticated enough to demonstrate the usefulness of invention in the performance of musical compositions. With the system of FIG. 5, as many as four notes can be turned on simultaneously since there are four sub-memories. In order that four notes be turned on, one key of each trigger mechanism must be depressed simultaneously, and valid data must be present at all outputs of the sub-memories; i.e., encoded musical notes which will be decoded by the control circuit, and thence cause the appropriate flip-flops 7' to set.

PROGRAMMING AND PERFORMING MUSIC

Heretofore, the description of the invention has focused primarily on the electrical functions of the system, in block diagram form. It is now appropriate to deal with the technique of translating musical information from the printed score into a form that can be manipulated by the electronic hardware of the invention. This involves not only numerically encoding the musical notes, but appropriately imbedding in the note sequence "blank" or toneless notes, as well, and causing certain notes to sustain, and others not to sustain.

Before the technique of musical programming can be demonstrated, however, the parameters of the system for which the music is programmed must be specified. This specification includes the following:

1. the domain of musical notes,
2. a code for each note of the domain,
3. the number of sub-memories available,
4. the number of trigger mechanisms available, and
5. the assignment of trigger mechanisms to sub-memories.

Figure 6:
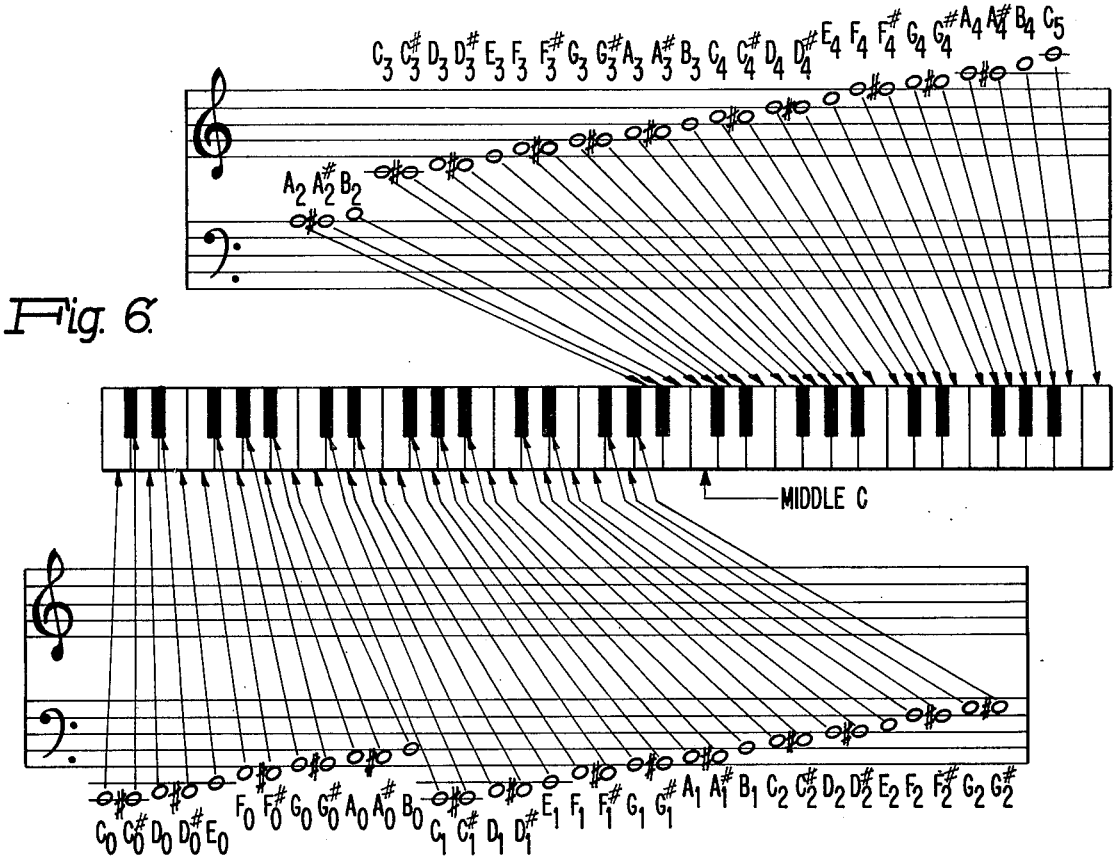
FIGS. 6 and 7A are diagrammatic musical staff charts relating the piano or organ keyboard with coded notations usable in the operation of the invention.

The illustrative system chosen to illustrate programming, has a domain of musical notes, shown with their codes in FIG. 6. The keyboard, with reference to middle C, is there-shown with arrows corresponding to the notes in the G clef and F clef and with subscripted code letter assigned thereto. This example has four sub-memories and two trigger mechanisms connected as shown in FIG. 5, with each trigger mechanism capable of sounding as many as two notes, simultaneously.

Observe that the sub-memories, from an electronic viewpoint, can store only binary coded information, that is, 0's and 1's. Thus the codes given in FIG. 6 cannot themselves be directly loaded into the sub-memories, but must first be passed through a binary encoder. A possible binary code for "$D_1$#" might be, as an example, "10110." The assignment of binary numbers to note codes is purely arbitrary and has no bearing on the technique of programming or on the final musical results of the machine. So long as the binary numbers generated by the binary encoder correspond to the proper tones after passing through the decoder, there is no way of telling which binary numbers represent which tones.

The musical programmer has at disposal, three types of notes that can be loaded into the sub-memories:

1. unsustained musical notes,
2. sustained musical notes, and
3. blank (toneless) notes.

An unsustained musical note will commence sounding upon depression of a trigger key, and will cease sounding upon release of the trigger key. A sustained musical note, on the other hand, will commence sounding upon depression of a trigger key and will continue to sound after the trigger key is released. A sustained musical note will continue to sound until the same note is summoned to turn on in an unsustained manner. When the sustained note is readdressed in an unsustained manner by the depression of a trigger key, no change in the note will occur until the trigger key is released, at which time the note will terminate. A blank note is simply a toneless note; it has a symbol and a binary code, yet it will cause no sound to be generated when decoded.

When multiple sub-memories are connected to one trigger mechanism, it may not be necessary, at times, to elicit one note from each sub-memory with a single depression of the trigger key. Often, only one sub-memory will be filled with a long sequence of notes while the others are to remain silent (in playing a single line melody, for example). In this case, sub-memories that are to remain silent will be filled with blank notes. Thus, as a trigger key is successively depressed to elicit musical notes from the active sub-memory, the silent sub-memories will eject blank notes. In such a manner, any combination of sub-memories can be used in programming to permit performances ranging from simple single line melodies to complex multi-voiced fugues. To emphasize, a blank note in a sub-memory has an equal importance with musical notes, the difference being that the musical notes will result in sound when called from memory, whereas blanks notes will not.

The symbology used to represent the three types of notes in a musical program is as follows:

1. For unsustained notes, the codes given in FIG. 6 are appropriate as they stand. Examples: $C_2^{\#}$, $D_1$, $A_4^{\#}$.
2. For sustained notes, the codes given in FIG. 6 plus the suffic *-s* are appropriate. The *-s* simply means sustain. Examples: $C_2^{\#}$-s, $D_1$-s, $A_4^{\#}$-s.
3. For blank notes, a dash is written: "-".

It will be recalled that all sub-memories store a sequence of numbers that represent musical notes. The elemental notes that make up a sequence of notes are stored in the format of "note bytes"; one note byte contains (a) one note code, (b) information indicating whether the note is to be sustained or unsustained, and (c) optional information that can be used to control note timbre, organ stops, external rhythm, or hold note byte identification numbers. Any number of auxiliary functions may be served by the optional information. A sequence of musical notes, then, will be stored in the sub-memories as a sequence of note bytes. The system used to illustrate programming will utilize note bytes that contain only a note code, sustain information, and a note byte identification number; other possible optional information that could be included will be eliminated in the further description, for simplicity.

The writing of a program simply consists of assembling a sequence of note bytes. The note codes and sustain information contained in the note bytes are derived from the musical score being programmed. Three basic steps are involved in program writing. They will be described and illustrated with a four part chorale by J. S. Bach, shown in FIG. 7B with the musical score vertically divided; that is, those notes to be played by the right hand are separated from those to be played by the left hand. The upper note sequence will be assigned to the right trigger mechanism, while the lower is assigned to the left. Some other vertical separation criterion might be desirable on occasion, but generally separation will be based on those notes normally played by the right and left hands. The system chosen to illustrate programming as before explained, is one with two trigger mechanisms, each controlling two sub-memories, allowing at most the sounding of a four note chord. The two parts resulting from vertical separation can each thus call for no more than two notes to sound simultaneously.

Figure 7A:
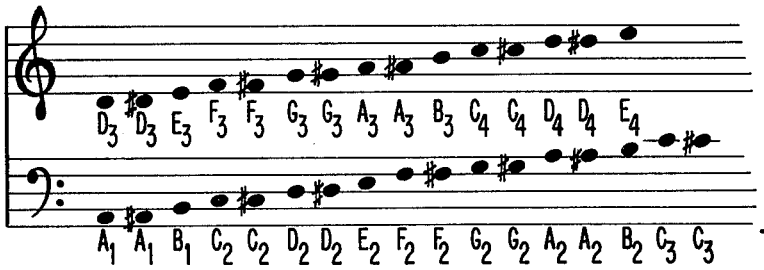
Figure 7B:
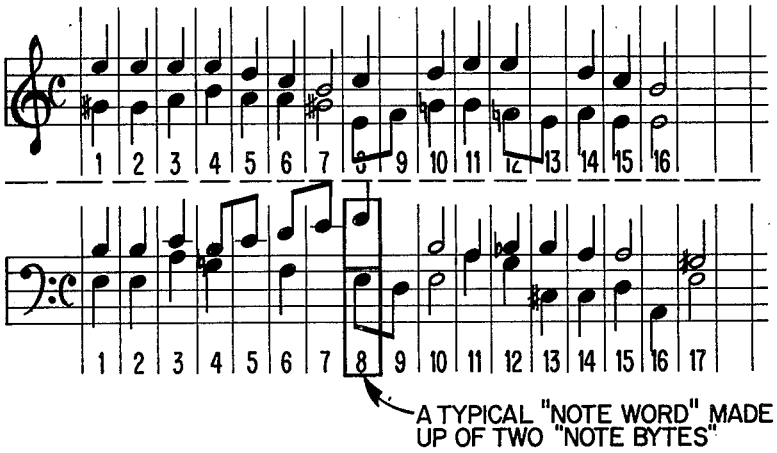
FIGS. 7B and 9 are charts of different code symbols for an illustrative piece of music.

The notes of the Bach Chorale are also shown in FIG. 7B as horizontally separated by the process of dividing a note sequence into descrete units along the time axis. These segments mark changes in the disposition of notes as one moves from left to right along the musical score. In the case of the Bach Chorale, at least one and not more than two notes will occupy a segment (vertically). The segments identify the notes that will be sounded when a trigger key is depressed. The segmentation is unrelated to the timing of the notes as indicated on the musical score; a single eighth note may occupy one segment as validly as a whole note. Indeed, it is the timing information that is not programmed. It is, indeed, this function that the performer must supply. The segments shown in both the upper and lower parts of the score of FIG. 7B are referred to as "note words" and are, in this case, each made up of two note bytes.

The score is now in a form ready to be coded. This simply involves translating each tone-bearing symbol into a capital letter with a numeric subscript as in FIG. 6, with a sharp superscript (when necessary), and a *-s* to indicate sustain (when necessary). For convenience, the code of FIG. 6 is reproduced in somewhat different form in FIG. 7A, so that translation of the assigned note word numbers of FIG. 7B can be readily seen, producing the program for the Bach Chorale tabulated in Table I hereof, as follows:

TABLE I

| Right Hand | | | Left Hand | | |
|---|---|---|---|---|---|
| Note Word No. | Sub-Memory 1 | Sub-Memory 2 | Note Word No. | Sub-Memory 3 | Sub-Memory 4 |
| 1 | $E_4$ | $G\#_3$ | 1 | $B_2$ | $E_2$ |
| 2 | $E_4$ | $G\#_3$ | 2 | $B_2$ | $E_2$ |
| 3 | $E_4$ | $A_3$ | 3 | $C_3$ | $A_2$ |
| 4 | $E_4$ | $B_3$ | 4 | $B_2$ | $G_2$-s |
| 5 | $D_4$ | $A_3$ | 5 | $C_3$ | $G_2$ |
| 6 | $C_4$ | $A_3$ | 6 | $D_3$ | $F_2$-s |
| 7 | $B_3$ | $G\#_3$ | 7 | $E_3$ | $F_2$ |
| 8 | $C_4$-s | $E_3$ | 8 | $F_3$-s | $E_2$ |
| 9 | $C_4$ | $F\#_3$ | 9 | $F_3$ | $D_2$ |
| 10 | $D_4$ | $G_3$ | 10 | $B_2$ | $E_2$ |
| 11 | $E_4$ | $G_3$ | 11 | $A_2$ | — |
| 12 | $E_4$-s | $F_3$ | 12 | $A\#_2$ | $G_2$ |
| 13 | $E_4$ | $E_3$ | 13 | $A\#_2$ | $C\#_2$ |
| 14 | $D_4$ | $F_3$ | 14 | $A_2$ | $C\#_2$ |
| 15 | $C_4$ | $E_3$ | 15 | $A_2$-s | $D_2$ |
| 16 | $B_3$ | $E_3$ | 16 | $A_2$ | $A_1$ |
| | | | 17 | $G\#_2$ | $E_2$ |

When a note is sustained, furthermore, it will be turned on by the depression of a trigger key but will not be turned off when that trigger key is released; it will continue to sound indefinitely. If the note is summoned to turn on again in a unsustained manner by some later depression of a trigger key, no change will initially occur since the note is already on. However, when the trigger key is released, the note will turn off. Thus, if a note has been sustained and it is desired to turn it off at some point, the program must anticipate the desired turn-off time by one note word, and address the note in an unsustained manner at that time. This is illustrated in note words 8 and 12 of the right hand, and 4, 6, 8, and 15 of the left hand part, Table I.

When the program is complete, it is passed through a binary encoder and loaded into the sub-memories. At this point, all preparation prior to performance is complete.

The performer will thus have before him the musical score in the vertically and horizontally separated form of FIG. 7B. The score in this format will show the performer which trigger mechanism will be controlling which notes, and which notes will actually sound when a trigger key is depressed. In addition, the score will hold the critical timing information in terms of eighth notes, quarter notes, half notes, etc. To play the music, the performer must observe the appropriate timing between notes as given on the score, and commence playing by depressing the trigger keys (1 and 1A FIG. 5) with the proper rhythm. When the note sequence recorded in the electronic memory 3 is brought forth by the performer with the proper rhythm, the musical piece is reproduced.

The invention thus provides the before-mentioned wide flexibility and simplicity with the use of electronic semiconductor memories to store encoded numeric binary data which, when properly decoded, cause selective flip-flops to set or reset, in turn operating electronic tone-producing agents, as distinguished from the beforedescribed prior-art techniques. The encoded numeric binary data is shifted out of electronic semiconductor memories when a trigger signal is generated on depression of a key, physically made to resemble keys of a piano or organ, and such depression generating an electrical trigger signal which electronically advances the semiconductor memories from one multiple bit data cell to another. The invention, unlike prior art preprogrammed selection of fundamental frequencies of vibration, addresses the theme of preprogrammed, automatic selection of fundamental frequencies of vibration with emphasis upon the independence of such from the tone generating means employed.

A Preferred Embodiment

The invention has been thoroughly tested in the form of a prototype embodying the circuits of FIG. 5. In this system, as previously explained, there are two trigger mechanisms, each controlling two sub-memories. Thus, at any one time, as many as four notes can be turned on. The electronic organ used in the prototype is capable of producing 57 unique fundamental tones (44 keys and 13 pedals), and thus a 57 note scale is available. The prototype utilizes a digital magnetic tape recording system to effect bulk storage of note words, and four sub-memories to trigger the transmission of note words to the control circuitry. In such a manner, very long sequences of note words may be stored in a compact, easily accessible, and economic form. Further, the digital tapes holding the note words may be kept for reuse at any time. A magnetic recording system is thus of major importance in making the invention economically feasible. Thus, a reasonable amount of detal will be presented on the digital magnetic tape recording system designed for the prototype.

The electronic memory of the prototype is made up of four sub-memories, two controlled by one trigger mechanism and two by a second trigger mechanism. The sub-memories, rather than being very long chains of data cells, are short chains of data cells each capable of storing, at most, 32 note bytes. These short chains of data cells are referred to as "first-in first-out" buffer memories, and they operate in such a manner that note bytes may be loaded into the memories at the input and extracted in the same order at the output. The primary feature of the first-in first-out buffer memories is that the input and output functions are completely independent of each other; data may be loaded at the input and extracted at the output simultaneously and at different rates. Of course, if the average rate of data input and data output is not the same, the first-in first-out memories will eventually either become depleted or filled to capacity, depending on whether the rate of input is less than or greater than the rate of output. The essential function of the first-in first-out buffer memories is to couple a data source (in this case, a digital tape recorder) which provides data at one rate, with a data receptor which accepts data at another rate. The sub-memories, then, are 32 cell first-in first-out buffer memories, with each cell capable of holding one note byte, and serve as temporary receptacles for note data removed from the magnetic tape.

Figure 8:
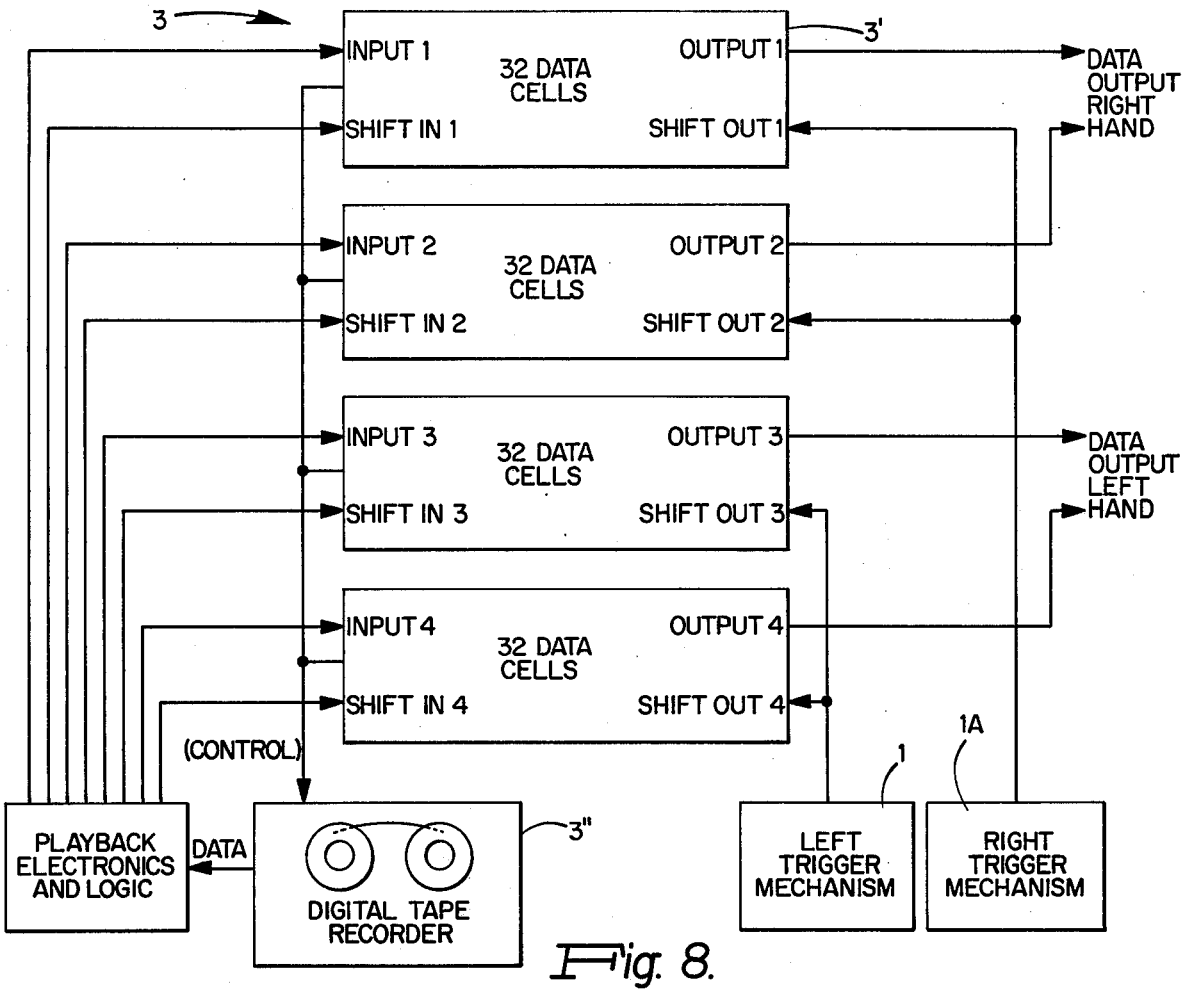
FIG. 8 is a block diagram of the interconnection of digital tape recorder, sub-memory, and trigger mechanisms involved in a preferred embodiment of the invention.

FIG. 8 illustrates the interconnection of the digital tape recorder, sub-memories, and trigger mechanisms.

Initially, all sub-memories 3' are empty. To load the memories, the digital tape recorder 3'' is started, at which time, note bytes are distributed one at a time to each sub-memory 3'. The note bytes are recorded on the tape in groups of four, these groups being referred to as "joint note words." The first note byte of a joint note word is always sent to the uppermost sub-memory 3', FIG. 8; the second, to the next sub-memory; and so on. When any sub-memory fills to capacity, a signal will be sent to the tape recorder 3'' to stop the tape motion at the end of the present joint note word. If no data has been removed from the sub-memories while they were filling, then they will all reach full capacity at the same joint note word. The tape motion will remain stopped until all sub-memories have at least one empty data cell and at least one sub-memory has passed a certain level of depletion (usually the half-full point; or in other words 16 vacant data cells). These are the 'start' criteria which, when met, cause tape motion to begin again and continue until any one of the sub-memories reaches full capacity. At such time, the tape motion ceases. Thus, the tape recorder 3'' will start and stop automatically continuously to refresh the sub-memories on demand. For a slowly played musical composition, note data will be shifted out of the sub-memories at a slow rate and the tape recorder will run only occasionally. For a rapidly played musical composition, on the other hand, note data will be shifted out of the sub-memories at a fast rate and the tape recorder may run almost constantly.

It will be remembered that for a sub-memory, two trigger mechanism system, as is shown in FIG. 5, note words were defined to contain two note bytes each. For that type of system, two sequences of note words would be necessary, one for the right hand pair of submemories and one for the left. Since the trigger mechanisms and the sub-memory pairs that they control are completely independent, direct extension of the two note byte per note word scheme would require two independent tape recorders. However, by compressing two note words into one joint note word, a satisfactory implementation is realized using only one tape recorder.

This joint note word-single tape recorder scheme, however, no longer allows complete independence of the trigger mechanisms, but rather insists on dependence at the data source. Specifically, when only one pair of sub-memories demands data, note bytes must be delivered to both.

As an example, consider the case where the right hand is required to play a long sequence of notes while the left hand is to remain inactive. The note data required by the right hand sub-memories would have to be delivered along with data for the left hand sub-memories, since the joint note words are bound to delivery data to both simultaneously. Because the left hand at this time is to remain inactive, the performer will not be operating the left hand trigger mechanism, and "blank" note bytes will continue to fill the left sub-memories without any being removed at the output. Eventually, the left sub-memories will reach capacity. When any one of the sub-memories reaches capacity, a signal will be generated that stops the tape recorder 3'', so that no note data is wasted. Thus, when the left sub-memories reach capacity, the tape recorder will stop. If the right hand now continues to play solo, eventually the right hand sub-memories will have been fully depleted, at which time further depression of right hand trigger keys yields nothing. This example illustrates the dependency at the data source when one tape recorder is used, and a problem that would result from the dependency. This problem is avoided, however, by a slightly different programming technique than that shown in Table I, and a small addition of hardware to the sub-memories. Such a programming technique and hardware addition will now be described.

Figure 9:
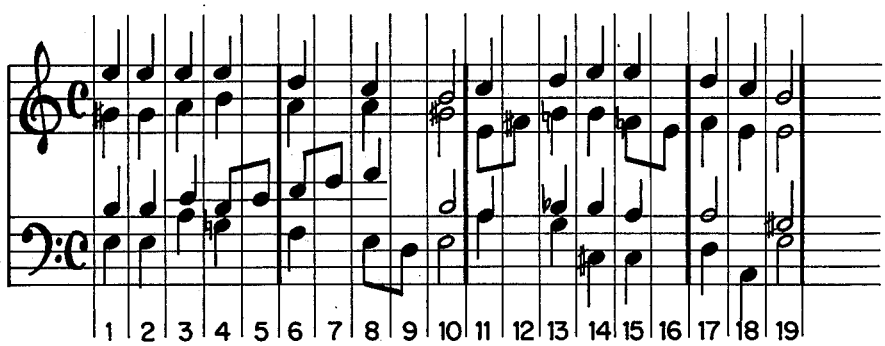

First, programming for a system with only one digital tape recorder precludes the vertical separation of FIG. 7B and Table I. Programming in this case must be based on joint note words rather than on just note words themselves. FIG. 9 illustrates this different programming of the same Bach Chorale used in the example of FIG. 7B. This programming technique forces the phase between right and left hand note word sequences to be the same. It does so by inserting dummy note words as filler whenever vacancies are created by one hand not playing notes at the same rate as the other hand. A dummy note word is simply a note word that consists of two blank note bytes. Joint note words may contain at most one dummy note word, as illustrated by note words 5, 7, 9, 12, and 16 of FIG. 9, with Table II presenting the differently programmed code:

TABLE II

| Joint Note Word No. | Right Hand Sub-Memory 1 | Right Hand Sub-Memory 2 | Left Hand Sub-Memory 3 | Left Hand Sub-Memory 4 |
|---|---|---|---|---|
| 1 | $E_4$ | $G\#_3$ | $B_2$ | $E_2$ |
| 2 | $E_4$ | $G\#_3$ | $B_2$ | $E_2$ |
| 3 | $E_4$ | $A_3$ | $C_3$ | $A_2$ |
| 4 | $E_4$ | $B_3$ | $B_2$ | $G_2$-s |
| 5 | — | — | $C_3$ | $G_2$ |
| 6 | $D_4$ | $A_3$ | $D_3$ | $F_2$-s |
| 7 | — | — | $E_3$ | $F_2$ |
| 8 | $C_4$ | $A_3$ | $F_3$-s | $E_2$ |
| 9 | — | — | $F_3$ | $D_2$ |
| 10 | $B_3$ | $G\#_3$ | $B_2$ | $E_2$ |
| 11 | $C_4$-s | $E_3$ | $A_2$ | — |
| 12 | $C_4$ | $F\#_3$ | — | — |
| 13 | $D_4$ | $G_3$ | $A\#_2$ | $G_2$ |
| 14 | $E_4$ | $G_3$ | $A\#_2$ | $C\#_2$ |
| 15 | $E_4$-s | $F_3$ | $A_2$ | $C\#_2$ |
| 16 | $E_4$ | $E_3$ | — | — |
| 17 | $D_4$ | $F_3$ | $A_2$-s | $D_2$ |
| 18 | $C_4$ | $E_3$ | $A_2$ | $A_1$ |
| 19 | $B_3$ | $E_3$ | $G\#_2$ | $E_2$ |

Ordinarily, dummy note words would have to be shifted out like any other note word by the depression of trigger keys. This, however, results in wasted motion on the part of the performer and reduces somewhat the pleasure accrued from performing. Thus, an addition to the hardware may be made that automatically generates shift-out pulses when dummy note words are detected. This hardware addition is referred to as a "blank detector" and senses a dummy note word by detecting the code for a blank note, whereupon a shift-out pulse is generated to automatically discharge the sub-memory of the dummy note word.

A joint note word, in addition to containing 4 note bytes, contains an identification number. On playback of the digital magnetic tape when performing, the joint note word identification numbers are shown on a numeric display, one at a time, as the joint note words pass across the tape head. These numbers can be coordinated with the segment numbers on the musical score, allowing a performer to locate the notes that will sound when the trigger keys are next depressed.

Figure 11:
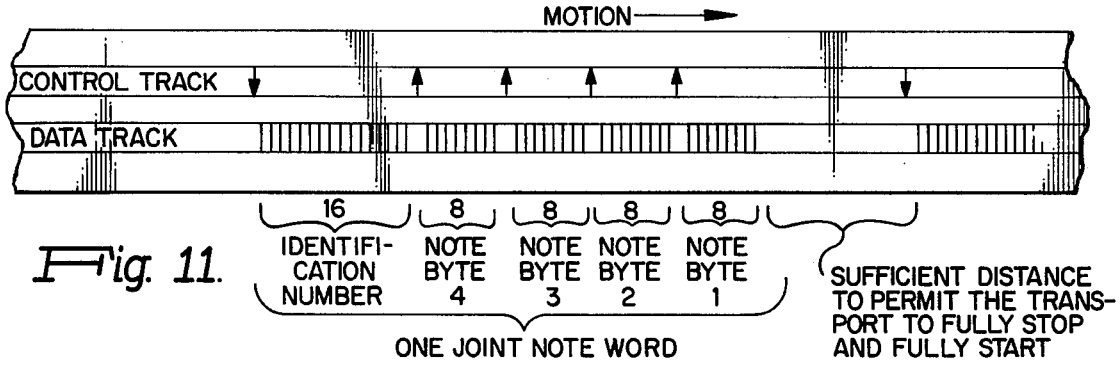
FIG. 11 is a schematic showing of tape recorded note byte data.

Note data is recorded on the magnetic tape at 3'', FIG. 8, in two channels. One channel is a control track; the other is a data track. Pulses on the control track mark border lines between note bytes and between joint note words. This is illustrated in FIG. 11 which shows a slice of the digital magnetic tape recording, illustrating one joint note word. Vertical lines on the tape represent binary data, and arrowheads, when shown, indicate a specific polarity. The first six bits of each note byte is a code for one of the 57 possible notes of the electronic organ; the seventh, indicates whether or not the note is to be sustained. The eighth bit is internally generated by the machine when the tape is recorded to assist in the data processing and has no musical meaning. Every joint note word is of exactly the same format.

Joint note words are separated on the tape by just enough distance to permit the tape recorder to stop at the end of a joint note word and start again without missing any data. The tape recorder will not necessarily stop after every joint note word, but rather only when one of the sub-memories fills to capacity. The time at which this happens is not predictable and may occur at different points each time the tape is played back. When the sub-memories reach a certain level of depletion, the tape recorder will start again to refresh them with new data.

Figure 12:
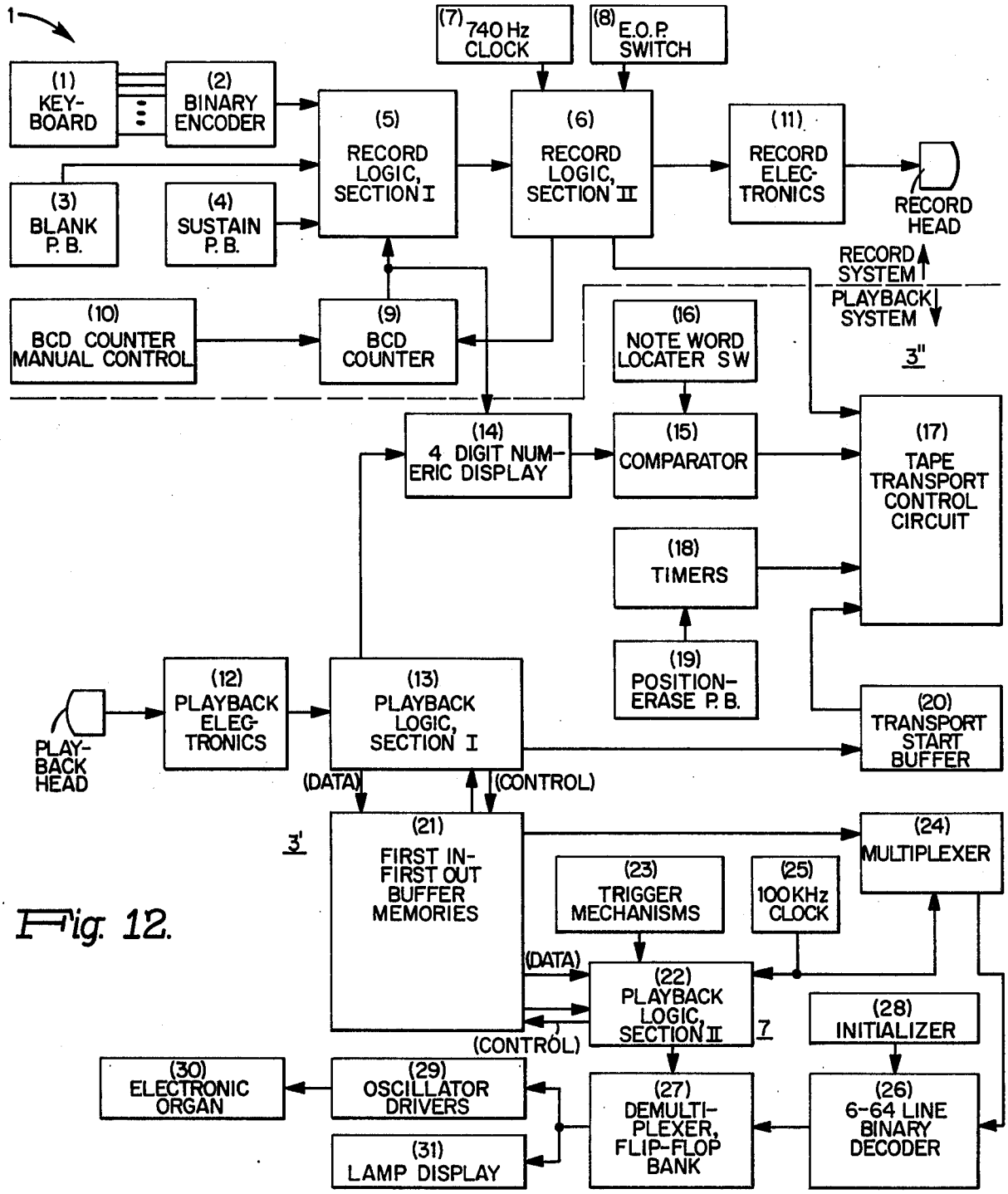
FIG. 12 is a fuller block diagram of the preferred embodiment of FIG. 8; showing, in addition, apparatus to record joint note words on digital magnetic tape.

Having now described the several workings of parts of the prototype system, it is now in order to treat with the electronic details of the system, as shown in FIG. 12, with the functions of the circuit blocks labeled and marked with numerals in brackets, as distinguished from the unbracketed numerals of the other figures of the drawing.

A musical keyboard 1 consisting of 44 finger-operated digitals and 13 foot-operated pedals is shown connected to a binary encoder 2 comprising an electronic circuit which generates a 6-bit code for each note of the keyboard. The appropriate code is generated whenever any one of the keys or pedals is depressed. A pushbutton 3 labeled "Blank P. B." is provided, which, when depressed, generates the code for a blank note byte. A further pushbutton 4 for post-trigger sustaining is also provided, which, when depressed simultaneously with a note from the keyboard 1, adds data to a note code, indicating that the note is to be sustained. Each of the binary encoder 2 and the pushbuttons 3 and 4 is connected to a record logic section I containing storage registers and control circuits which temporarily hold note byte data until a total of four note bytes have been accumulated (one joint note word). In addition, note word identification numbers are added here just prior to transfer of the data to the magnetic tape. The record logic section I is connected with a second record logic section II containing timing circuits to provide shift pulses for the storage registers of 5 and to generate control pulses for the control track of the tape, as shown in FIG. 11. The time base for the record logic is provided by a 740HZ clock 7. Depression of an end-of-program pushbutton 8 labeled EOP, at the end of a recording session causes a code to be recorded on the tape that automatically stops the tape recorder when this point on the tape is reached during playback.

A numeric BCD counter 9 generates the joint note word identification numbers, the counter automatically advancing by one, every time a joint note word is recorded on the magnetic tape. Switches that permit the joint note word identification counter to be manually set to some specified number are indicated at 10. An electronic record circuit which converts the binary levels provided by the record logic II 6 into appropriate current pulses is provided at 11 to drive the tape recorder's record head, so-labeled. The playback function of the playback head assembly is effected through an electronic playback circuit 12 which converts voltage pulses generated by the tape recorder playback head into binary levels, applying the same to a playback logic section I 13 that decomposes the joint note words into four note bytes and an identification number. The note bytes are loaded one at a time into their appropriate sub-memories 3′ as at 21, while the joint note word identification number is transferred to a numeric display 14. When recording, the 4 digit numeric display 14 indicates the note word number that is about to be recorded; while during playback, it displays the note word number which last passed across the playback head.

Logic comparator circuitry 15 is used on playback only to permit the rapid location of one joint note word in a recording. Said circuit when used compares the 4 digit number displayed on the numeric display 14, with a number determined by the position of 4 rotary switches 16 that are set to the joint note word number being sought. When the 4 digit numbers match, a signal will be generated to stop the tape recorder.

A transport control circuit 17 is provided for determining whether the tape is to move across the playback (or record) head, or is to stop. The transport may be signaled to start and stop by a number of different peripheral circuits. The effect is always the same, however, in that the tape is caused to either be put into motion or stopped.

Timing circuits 18 for running the tape transport for short, predetermined lengths of time are used correctly to position recorded joint note words with respect to the erase and record heads of the tape recorder, prior to erasure and re-recording of a single joint note word. This permits facile correction of programming errors, with switches 19 enabling the setting of the time intervals and the triggering of the short run periods.

Transport start buffer 20 is shown connected to receive an input from the playback logic section I 13 and feeding the tape transport control circuit 17. This circuit measures the data level in the sub-memories; and when a certain level of depletion is reached, starts the tape transport to refresh the memories. The previously described first-in first-out buffer memories are shown at 21, connected between the playback logic section I 13 and the playback logic section II 22. The latter provides logic circuitry for coupling the trigger mechanisms with the sub-memories, for decoding note sustain data, and for sending multiplex synchronizing pulses to the flip-flop bank 27.

Electronic trigger mechanisms 23 control the playback logic section II 22 by translating the depression of keyboard keys into non-overlapping binary voltage levels. The before-mentioned synchronizing pulse output of the logic section II 22 controls a multiplexer logic circuit 24 that receives its input from the buffer memories 21 and a 100 KHZ time base clock 25 and time-division multiplexes the four 6 bit lines of the sub-memory outputs into one 6 bit line. A binary decoder for the latter is provided at 26, decoding the binary coded information at its input to select one of 57 possible lines. Seven of the 6 bit binary codes in this prototype are not used. A flip-flop bank of 57 flip-flops, one per musical tone, demultiplexes data from the binary decoder 27, and the appropriate flip-flops are correspondingly set or reset. Oscillator drivers 29 convert the binary levels of the flip-flop bank into appropriate drive currents for the tone oscillators in the electronic organ 30, which is of the commercial type, complete with tone oscillators, audio amplifier, speaker, and keyboard, modified to be operated by the oscillator drivers 29.

An initializer circuit 28 is also provided that will reset all flip-flops 27 on command; the initializer being used when the power is first turned on to reset any flip-flops that may have randomly set. An array of indicator lamps 31 is also employed, one for each flip-flop of the flip-flop bank 27, such that when a note is turned on, the lamp corresponding to that note luminesces.

Suitable well-known components and sub-assemblies that may be used in the system of FIG. 12 and the other embodiments of the invention include the following: binary encoder 2 of the diode type, as described, for example, in the text, "Integrated Electronics," by Millman and Halkias, McGraw Hill, 1972; logic sections 5, 6, 13, 9, and 22, composed of integrated circuit digital logic elements similar to, for example, Texas Instruments SN7400 'NAND' gates, SN7402 'NOR' gates, SN74121 monostable multivibrators, SN74195 parallel input - serial output shift registers, SN7490 binary coded decimal counters, SN7493 natural binary counters, SN7404 inverters; 4 digit numeric display 14 composed of integrated circuit digital logic elements similar to, for example, Texas Instruments SN7446 BCD-to-seven segment decoder/driver circuits, and seven segment light emitting diode numeric display circuits similar to, for example, the OPCOA Inc. display "SLA-1"; comparator 15 utilizing integrated circuit digital logic elements similar to, for example, Texas Instruments SN7486 "exclusive OR" gates, SN7404 inverters, SN7430 'NAND' gates, SN7402 'NOR' gates; tape transport control circuit 17 composed of integrated circuit digital logic elements similar to Texas Instruments SN7402 'NOR' gates, SN7400 'NAND' gates, SN7404 inverters, and 2N1304 NPN transistors; timers 18 composed of integrated circuit digital logic elements similar to Texas Instruments SN74121; first-in first-out buffer memories of a type similar to Fairchild Semiconductors No. 3341 "64 word by 4 bit First-In First-Out Serial Memory"; demultiplexer, flip-flop bank 27 and and decoder 26 composed of integrated circuit logic elements similar to Texas Instruments SN74154 "4 Line to 16 Line Decoder/Demultiplexer" and SN7402 'NOR' gates; initializer 28 composed of integrated circuit digital logic elements similar to Texas Instruments SN7493 natural binary counters, and SN7400 'NAND' gates; oscillator drivers 29 composed of integrated circuit digital logic elements similar to Texas Instruments SN7406 inverters, open collector; multiplexer 24 composed of integrated circuit digital logic elements similar to Texas Instruments SN74153 "Dual 4-Line-to-1-Line Data Selector/Multiplexer" circuits; transport start buffer 20 composed of integrated circuit digital logic elements similar to Texas Instruments SN7493 natural binary counters, and SN7400 'NAND' gates; record electronics 11 and playback electronics 12 composed of discrete NPN and PNP switching transistors, integrated circuit operational amplifiers such as Burr-Brown No. 3329, and integrated circuit digial logic elements such as Texas Instruments SN74121 monostable multivibrators, SN7474 D-type flip-flops, and SN7400 'NAND' gates. Other well-known components may also be used, as described in said Letters Patent and as are known in the art.

Figure 13A:
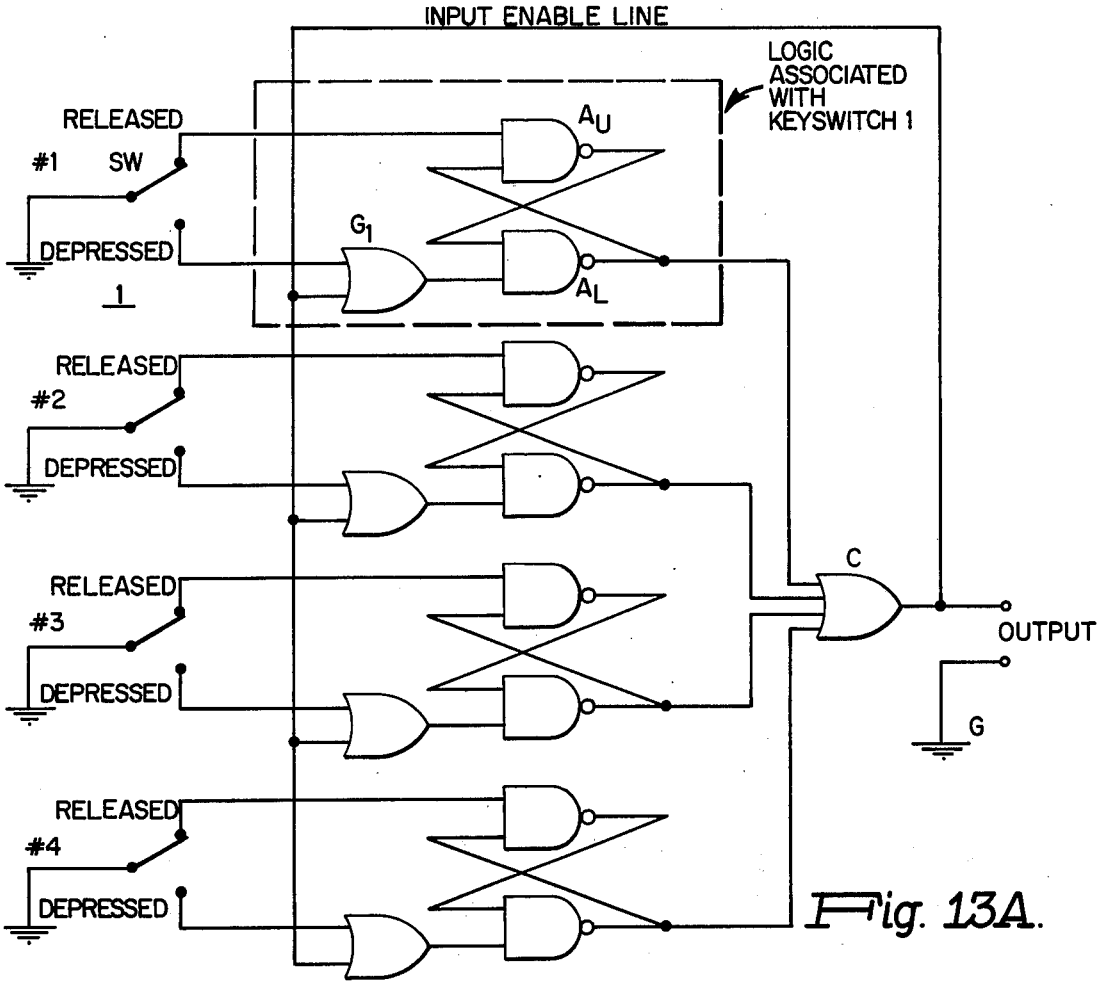
FIGS. 13A, 14A and 15A are circuit diagrams of preferred electronic triggering circuits for use in the systems of FIGS. 5, 8 and 12 and the other embodiments of the invention.

While various known types of electronic triggering circuits may be used in connection with the triggering mechanisms of the invention, a preferred circuit is shown in FIG. 13A, providing an electrical stimulus to various functional blocks of the system in response to the depression of any one of a multitude of trigger keys.

Figure 13B:
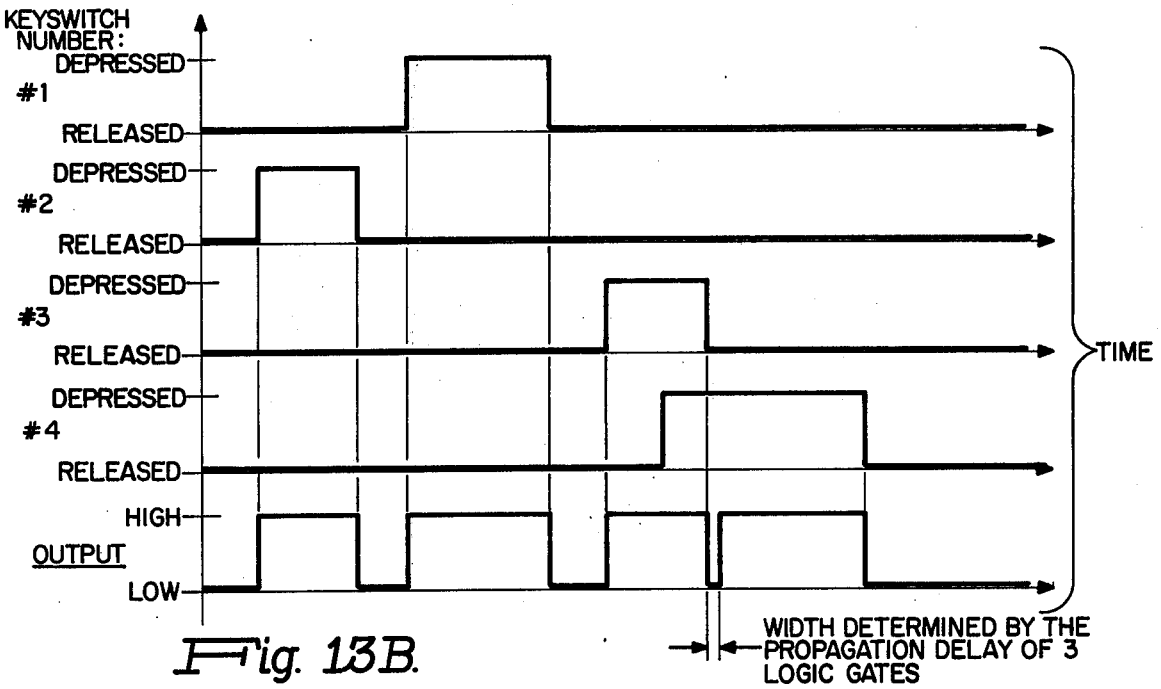
FIGS. 13B, 14B and 15B are corresponding operational waveform diagrams.

The electronic triggering circuit is made up of digital logic elements, has one output terminal (referenced to ground G) from which an electrical stimulus is sensed, and two or more inputs. Each input is made up of a single-pole double-throw switch operated by a key from a musical keyboard, such as illustrated at SW, for the uppermost of the four units No. 1, No. 2, No 3, No 4, of FIG. 13A. Each circuit comprises an OR gate $G_1$ connected with an "input enable line" and the depressed switch line, and feeding the lower NAND circuit $A_L$. The other input to $A_L$ is derived from the output of the upper NAND circuit $A_U$ the inputs of which are connected with the "Released" switch position and the output of $A_L$. The outputs of each logic circuit connected with key switches No. 1, No. 2, No. 3, No. 4, are combined at C for final output. The function of this circuit is twofold. First, it is to provide a voltage change at the output from a low level to a high level whenever any one of the input keys is depressed. The output will remain in the high state exactly the length of time the key is depressed, and will return to the low state when the key is released, as shown in the waveform diagrams of FIG. 13B. Second, the trigger circuit is to prevent the release of one key from electrically interfering with the simultaneous depression of another. If overlap occurs, as indicated by key switches No. 3 and No. 4 in the waveforms of FIG. 13B, a brief negative going transition will appear at the output to separate the high output level caused by the first depression from that caused by the second depression.

Ordinarily, all keys are released and all keyswitches open causing all inputs to be low and the output to be low. Note that an unconnected logic gate input assumes a logic 1 value. When this is the case, the "input enable line," FIG. 13A, is low thus enabling all inputs. When any one input changes to the high state as the result of a keyswitch closing, the logic gates corresponding to that input (such as $G_1$) produce a high level output and in so doing become locked in that state and independent of the input enable line. Following this, the output changes to a high level, FIG. 13B, and the input enable line also changes to a high level to disable all unused inputs. Thus, any level changes occuring at peripheral inputs after the first keyswitch is closed will have no effect whatsoever on the output. When the keyswitch that was initially closed is opened by the release of its corresponding key, the output will return to the low level and remain there until another key depression takes place.

Should a second key be depressed before a prior key is released, no change will initially take place at the output because the input enable line, high as a result of the depression of the first key, is blocking any change in the logic gates associated with the second key. When the first key is eventually released, the logic gates associated with the first key will cause a low level to be present at the output and the input enable line. The instant the input enable line goes to a low level, the depressed condition of the second key causes the logic gates associated with the second key to change state which in turn cause a high level to return to the output. The duration of the low level output when key release-depression overlap takes place is determined by the gate propagation delay time of the logic gates used, the gate propagation delay being the time delay between a change at the gate input being reflected by a change at the gate output.

Figure 14A:
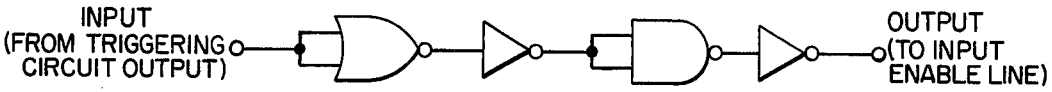
Figure 14B:
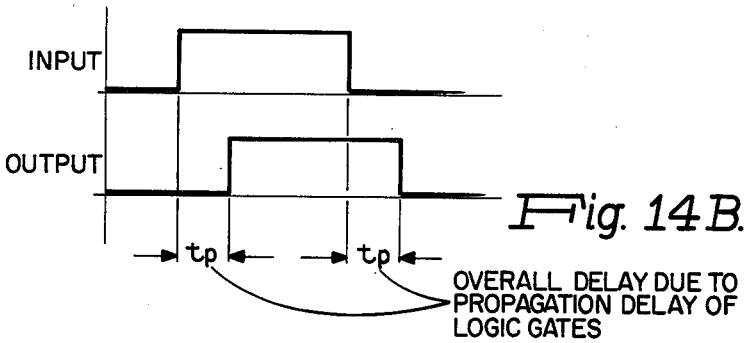
Figure 15A:
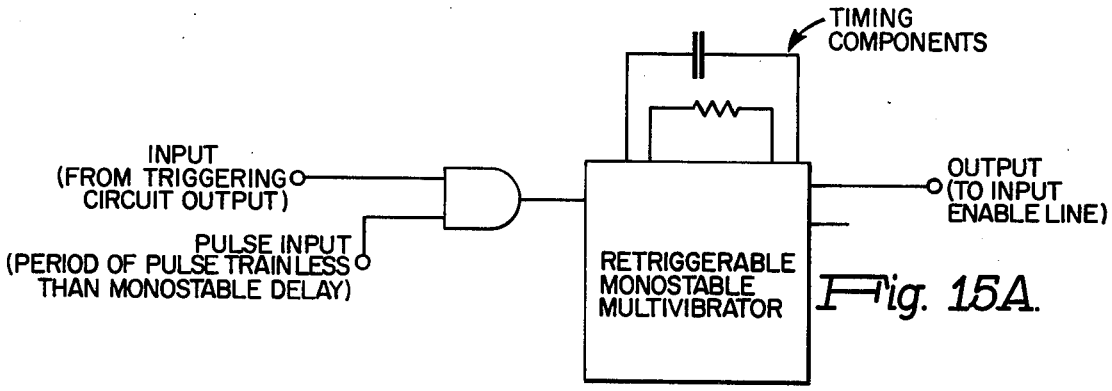
Figure 15B:
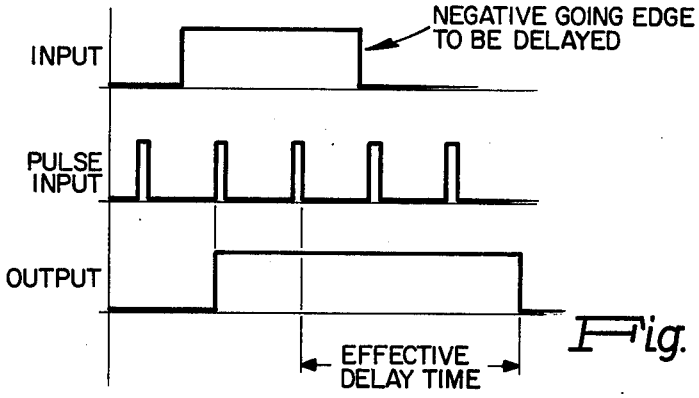

As shown, the signal generated by the release of the first key must propagate through three logic gates before it reaches a point where it can affect the logic gates associated with the second key. If the average gate delay were 15 nanoseconds, for example, then the low level at the output would persist for 45 nanoseconds. This time may be dilated by inserting some non-inverting configuration of logic gates between the "output" and the "input enable line", as shown in FIG. 14A, producing the waveforms of FIG. 14B. Alternatively, a retriggerable monostable multivibrator (such as Texas Instruments SN74123) may be inserted between the "output" and the "input enable line," as shown in FIG. 15A. When a monostable multivibrator is so used, the time duration of the low level pulse is a function of the monostable's timing components, producing the output waveform of FIG. 15B.

If, for example, the binary codes representing musical notes are arranged in increasing order as one moves up the scale ($D_3$ - 10000, $D_3^{\#}$- 10001, $E_3$ - 10010, $F_3$ - 10011, etc., for example), automatic transposition of a scale up or down by any number of half tones can be achieved by inserting a binary adder-subtractor between the sub-memory outputs and the binary decoder, as schematically illustrated at regions BA-S and BA-S′ in FIG. 5. Thus, if a musical composition has been programmed in C major, for instance, it could be performed in C # major by adding 1 to every binary note code prior to decoding, or in B major by subtracting 2 from every binary note code prior to decoding at BA-S and BA-S′.

While the invention has been described, moreover, in connection with an electronic organ as the musical output, it so may also be applied to any musical instrument when appropriate coupling is provided to operate the tone-producing controls of the instrument. For instance, the invention may be directly applied and used, with minor modifications, to operate a piano, harpsichord, clavichord, pipe organ, or an electronic music synthesizer. The use of the invention with a pipe organ, could embody the control of electrically operated air valves, as shown in FIG. 28, producing columnar vibrations that become converted into audible tones. When adapted for piano use, electrically operated solenoids, FIG. 29, may, through mechanical links, cause key operation that effects string oscillation that becomes connected in air into corresponding audible notes. A large system with many sub-memories, moreover, could be connected to a number of different electronic music synthesizers, each producing tones of different timbre, to simulate a symphony orchestra.

It has before been mentioned that each note byte must contain one note code and note sustain information, and, in addition, it may contain optional information. Some of the uses for such optional information, which may, for example, occur after the 16 bit identification number of FIG. 11, are as follows:

a. Timbre control for the note contained in the note byte would specify the tone quality of that note. Such additional data might switch on or off supplementary oscillators, filters, or noise generators, schematically represented in FIG. 16, connected at 30 of FIG. 12, for the duration of a single note, or indefinitely.

b. On electronic and pipe organs, optional data could cause a note to be sounded on any number of keyboard manuals, or to be eliminated altogether by routing it to a non-existant location, as in FIG. 17.

c. Optional data could be added that holds harmony information about the musical note contained in the note byte. For instance, it may contain two additional note codes, one for the note a musical sixth above the given note, and one for the note a musical third below. Such harmony information could be used automatically to synthesize a new harmonic structure for the musical composition. It could, for instance, transpose part or all of a musical composition from the major mode to the minor mode, as in FIG. 18, showing a generalized optional data gating to the multiplexer.

d. As a teaching aid, harmonic information could be added to each note byte for the purpose of indicating chord types and relations or figured bass. This information might be displayed on an alphanumeric display or an electronic cathode ray tube display, for example, schematically illustrated in FIG. 19.

e. Optional data could be added that controls a visual display circuit, again schematically shown in FIG. 20. In this way, light or color patterns could be programmed with the music and on playback, impart a visual effect appropriate for the music.

f. Optional data could be used to trigger an automatic page turner, such as the one described in U.S. Pat. No. 3,665,093, at prescribed times, as schematically illustrated in FIG. 21. This would alleviate the burden of lifting a hand from the trigger mechanisms to turn pages. Further, if an electronic display were used to display the musical score rather than printed sheet, not only could the musical score be automatically advanced as the performer played, but electronic pointers could be added to indicate exactly which notes are being played.

g. Optional data could be added to a note byte that would gate trigger signals, as schematically indicated in FIG. 22, intended for the sub-memory from which that note byte came to additional sub-memories. This would allow a performer to choose the number of trigger mechanisms he wishes to operate in performing a musical composition. A beginner, for example, might wish to play a four voice fugue with only one trigger mechanism and one hand. An advanced performer, however, may wish to play the same fugue with four trigger mechanisms. With the appropriate optional data added, both could be played with one program.

h. Optional data could be used to flash tempo and volume messages to the performer by way of an alphanumeric display or cathode ray tube, as previously indicated in FIG. 19.

i. By using the optional information to hold timing information, as in FIG. 23, trigger pulses could be generated by the program, this providing an automatic play feature. In this case, the note timing would be programmed as well, eliminating the need for a performer. The note timing would be quite rigid, however, lending to a mechanical sounding performance.

As another modification, by using a second tape player, schematically shown in FIG. 24, to play a sequence of pre-recorded trigger signals corresponding to a musical program, automatic performance is achieved. The trigger signals would be recorded by a human performer at a prior time while playing the music with the aid of the present invention. Trigger signals could also be studio recorded by various professional musicians performing with the invention. Playing different trigger tapes of the same musical composition would permit various interpretations of the same musical program.

Note word identification numbers, when entered on a numeric keyboard, schematically shown in FIG. 25, would cause the note word with that number to be quickly located by a rapid automatic scan of the tape. This would permit a performer to begin playing at any point in a musical composition, or to return to a certain point and begin over.

It would be difficult to operate more than two trigger mechanisms with only two hands. To preserve the one-limb-per-trigger mechanism ratio, foot-operated trigger mechanisms could be used. Depression of a pedal with the proper rhythm would generate trigger signals for one or more sub-memories, such as, for example, the trigger 1A of FIG. 5.

External to the trigger mechanisms, moreover, one could provide a trill or other supplemental keyboard, as in FIG. 26. It could consist of three keys, each capable of causing notes to sound when depressed but incapable of advancing the sub-memories. The center key, when depressed, would sound the note that would have sounded had a trigger key been depressed, while the right key would sound a note on half tone higher and the left key a note one half tone lower. When the trill is completed, an 'advance' pushbutton would be pushed by the performer to advance the appropriate sub-memories.

When performing music, furthermore, the performer will usually operate two or more trigger mechanisms. It is his or her responsibility to operate all trigger mechanisms with the proper rhythm. Should the performer lose place on the score at some time, it is possible for certain parts to become out of phase, the major source of error in performing with the aid of the invention. A numeric display for each trigger mechanism, shown in FIG. 27, would indicate which note word that trigger mechanism is about to sound. When the number on each display is the same, the parts would be in phase; if not, then such phase coincidence is not present. This numeric data may thus be used to correct phase errors. The numbers shown in the numeric displays of FIG. 27 illustrate one possible combination of note words and show that trigger mechanism No. 2 is two note words behind the other trigger mechanisms.

As still a further modification, in FIG. 31, a binary adder-subtractor is shown interposed between the multiplexer 24 and the binary decoder 26 of FIG. 12 for predictably numerically modifying the numerical musical codes by addition or subtraction of a given numerical quantity to each code in order correspondingly to modify the decoding such as to modify the oscillator frequency excited and thus to modify the ultimate musical tone that is produced.

In connection with the electronic memory construction, moreover, the digital tape recorder 3'' may be connected with an integral but unspecified number of buffer registers, as in FIG. 32, operated with their input and output control functions being asynchronous and rate independent, as previously suggested.

While rhythm information corresponding to the musical composition may be provided by an external prerecorded record to generate trigger signals that may enable automatic performance, as with the aid of supplementary apparatus of the type illustrated in FIG. 24, ancillary coded data as detailed in the digital magnetic tape diagram of FIG. 33, such as such rhythm information, may be caused, on decoding, to generate trigger signals for the above and other uses.

Further modifications will occur to those skilled in this art and all such are considered to fall within the spirit and scope of the invention as defined in the appended claims.

What is claimed is:

1. A method of electronically aided musical performing, that comprises, electronically storing coded data corresponding to successive musical notes in a musical composition; successively triggering by a human performer the controlled release of successive coded data from said storing in accordance with the rhythm of such composition; upon said release, generating from the successive data, oscillations corresponding in frequency to the corresponding musical notes; and converting said oscillations into the corresponding audible tones of the notes of the composition.

2. A method as claimed in claim 1 and in which said generating is effected by producing electrical oscillations, and said converting is effected by transducing said oscillations into sound.

3. A method as claimed in claim 1 and in which said generating and converting are effected by operating electrically controlled valves corresponding to tone-producing pipes of different lengths of a pipe organ to produce vibrational column oscillations in the pipes corresponding in frequency to the corresponding musical notes, such vibrational oscillations being converted within the corresponding pipes into corresponding audible tones of the notes of the composition.

4. A method as claimed in claim 1 and in which said generating is effected by operating solenoid-actuated keys of a piano corresponding to different frequency strings to produce vibrational oscillation of the strings corresponding in frequency to the corresponding musical notes, such oscillations being converted in the air into corresponding audible tones of the notes of the composition.

5. A method as claimed in claim 1 and in which said triggering is effected at a plurality of locations, sometimes simultaneously, to enable the generating of simultaneous notes including chords.

6. A method as claimed in claim 1 and in which said storing is effected by recording numerically encoded musical data in its native sequence on one or more recording channels of a digital magnetic tape; and said release of data is effected by playback from said tape to enable electronic processing in said generating step that reconstructs recognizable musical tones and patterns.

7. A method as claimed in claim 1 and in which said storing is effected in a known order in a semiconductor memory; and said release of data is effected by withdrawing the same from the semiconductor memory in the proper sequence to enable electronic processing in said generating step that reconstructs recognizable musical tones and patterns.

8. A method as claimed in claim 1 and in which said triggering is effected by depressing levers physically resembling at least one of piano and organ keyboards, and organ pedalboards.

9. A method as claimed in claim 1 and in which said musical notes are selected from a domain of musical notes ranging from four octaves below middle C to four octaves above middle C, and subsets thereof.

10. A method as claimed in claim 1 and in which said generating step comprises exciting vibratory oscillations in pipes, and said converting step comprises causing said oscillations to resonate air in the pipes to produce audible tones.

11. A method as claimed in claim 1 and in which said generating step comprises vibrating strings, and said converting step comprises causing the vibrating strings to react in air to produce audible tones.

12. Electronically aided musical apparatus having, in combination, electronic memory means for storing successive coded data corresponding to successive musical notes in a musical composition; decoding means; oscillator means for producing oscillations; control circuit means connected between said memory means and said decoding means for releasing, when effective, successive coded data from the memory means to the decoding means in order to decode the same; trigger means operable by a human performer connected to render the control circuit means effective, thereby to cause the decoding means to decode the successive coded data released from said memory means; means for connecting the oscillator means with said decoding means to respond to the successive decoded data and correspondingly to generate corresponding-frequency electrical oscillations; and audio means connected with the oscillator means for converting said oscillations into corresponding audible tones of the notes of the composition.

13. Apparatus as claimed in claim 12 and in which said oscillator means comprises a plurality of oscillators each of which is operated by a flip-flop, such that when the flip-flop is in the 'set' state, the oscillator corresponding to said flip-flop is excited and produces its tone; whereas when a flip-flop is in the 'reset' state, the oscillator corresponding to said flip-flop is quiescent and produces no tone, and with the flip-flops being ordered selectively to set and reset according to the musical data decoded by said decoding means.

14. Apparatus as claimed in claim 12 and in which binary adder-subtractor means is inserted between said memory means and said decoding means numerically to modify the numerical musical codes in a predictable manner by way of addition or subtraction of a given numerical quantity to each code, thereby producing a modification of the decoding, resulting in a modification of the oscillator means excited and a corresponding modification of the musical tone produced.

15. Apparatus as claimed in claim 12 and in which said electronic memory means comprises (a) a digital magnetic tape player on which digital magnetic tapes bearing coded numerical data that represent the musical notes of the musical composition may be played; one or more buffer registers to which data from the digital magnetic tape is distributed, said buffer registers being operated in such a manner that their input and output control functions are asynchronous and rate independent and such as to provide data at their outputs at a different instantaneous rate than the data provided to them by the digital magnetic tape player.

16. Apparatus as claimed in claim 12 and in which means is provided containing rhythm information corresponding to said musical composition in coded form, an ancillary data to said coded note data; such ancillary coded data means operable, when decoded, to cause the generation of trigger signals corresponding to the rhythm of said musical composition.

17. Apparatus as claimed in claim 12 and in which means is provided containing rhythm information corresponding to said musical composition and such means is connected to said control circuit by an external pre-recorded record to provide said trigger signals, enabling the automatic performing of a musical performance.

18. Apparatus as claimed in claim 12 and in which means is provided for appending to said successive coded data, corresponding to successive musical notes in a musical composition, additional coded data specifying a particular note timbre to be associated with each coded note frequency; further decoding means is provided connected to said last-named means to translate said appended note data; and filter and modulation means is provided, connected to said oscillator means and responsive to said decoding means, to modify the fundamental frequencies produced by said oscillator means in accordance with the appended note data.

19. Apparatus as claimed in claim 12 and in which means is provided for appending to said successive coded data, corresponding to successive musical notes in a musical composition, additional coded data representing identification numbers which correspond to both the encoded musical notes and to the printed musical score; further decoding means is provided connected to said last-named means for decoding said identification numbers; and further display means is provided visually to display the decoded identification numbers to allow coordination between the musical score and the encoded note data, providing a reference point for the performer should he become disoriented with respect to the musical score.

20. Apparatus as claimed in claim 12 and in which means is provided for appending additional coded data for producing at least one of alpha-numeric display, rhthym coordination, visual display, timing information and automatic page turning.

* * * * *